US010480501B2

(12) United States Patent
Tolman et al.

(10) Patent No.: US 10,480,501 B2
(45) Date of Patent: Nov. 19, 2019

(54) NESTED BELLOWS PUMP AND HYBRID DOWNHOLE PUMPING SYSTEM EMPLOYING SAME

(71) Applicants: Randy C Tolman, Spring, TX (US); Michael C. Romer, The Woodlands, TX (US)

(72) Inventors: Randy C Tolman, Spring, TX (US); Michael C. Romer, The Woodlands, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 113 days.

(21) Appl. No.: 15/945,488

(22) Filed: Apr. 4, 2018

(65) Prior Publication Data

US 2018/0313347 A1 Nov. 1, 2018

Related U.S. Application Data

(60) Provisional application No. 62/523,110, filed on Jun. 21, 2017, provisional application No. 62/491,563, filed on Apr. 28, 2017.

(51) Int. Cl.
*E21B 43/12* (2006.01)
*F04B 45/027* (2006.01)
(Continued)

(52) U.S. Cl.
CPC ..... *F04B 45/027* (2013.01); *E21B 43/08* (2013.01); *E21B 43/126* (2013.01);
(Continued)

(58) Field of Classification Search
CPC ..... F04B 47/027; F04B 47/06; F04B 53/10; E21B 47/0007; E21B 43/128;
(Continued)

(56) References Cited

U.S. PATENT DOCUMENTS 6,328,102 B1 12/2001 Dean
7,111,675 B2 9/2006 Zisk, Jr.
(Continued)

FOREIGN PATENT DOCUMENTS

EP 2 077 374 A1 7/2009
GB 2 393 747 A 4/2004
(Continued)

*Primary Examiner* — Brad Harcourt
(74) *Attorney, Agent, or Firm* — ExxonMobil Upstream Research Company—Law Department

(57) ABSTRACT

A nested bellows pump including a housing having a first end and a second end, the housing having a cylindrical body, the cylindrical body having an inner wall; a traveling bulkhead, the traveling bulkhead sealingly positionable along the inner wall of the cylindrical body; a first inner bellows, the first inner bellows connected to the housing, and the second bellows is connected to the traveling bulkhead; a second inner bellows connected to the traveling bulkhead, and the second end of the second inner bellows is connected to the housing; a first outer bellows connected to the housing, and the second end of the first outer bellows is connected to the traveling bulkhead; and a second outer bellows connected to the traveling bulkhead, and the second end of the second outer bellows is connected to the second end of the housing.

38 Claims, 8 Drawing Sheets

(51) Int. Cl.

| | |
|---|---|
| ***E21B 47/00*** | (2012.01) |
| ***E21B 43/08*** | (2006.01) |
| ***F04B 53/10*** | (2006.01) |
| ***F04B 47/06*** | (2006.01) |
| *E21B 47/06* | (2012.01) |
| *E21B 33/12* | (2006.01) |
| *E21B 23/01* | (2006.01) |
| *E21B 34/08* | (2006.01) |

(52) U.S. Cl.
CPC ..... *E21B 43/128* (2013.01); *E21B 47/0007* (2013.01); *F04B 47/06* (2013.01); *F04B 53/10* (2013.01); *E21B 23/01* (2013.01); *E21B 33/12* (2013.01); *E21B 34/08* (2013.01); *E21B 47/06* (2013.01); *E21B 47/065* (2013.01)

(58) Field of Classification Search
CPC ..... E21B 43/08; E21B 43/126; E21B 47/065; E21B 33/12; E21B 23/01; E21B 34/08; E21B 47/06; E21B 33/03; E21B 43/121
See application file for complete search history.

(56) References Cited

U.S. PATENT DOCUMENTS

| | | | | |
|---|---|---|---|---|
| 7,322,803 | B2 | 1/2008 | Vogeley | |
| 7,484,940 | B2 | 2/2009 | O'Neill | |
| 7,597,150 | B2 | 10/2009 | Clem | |
| 8,133,041 | B2 | 3/2012 | Ludlow et al. | |
| 8,220,533 | B2 | 7/2012 | Longfield et al. | |
| 8,511,390 | B2 | 8/2013 | Coyle et al. | |
| 2002/0197174 | A1 | 12/2002 | Howard | |
| 2003/0010491 | A1 | 1/2003 | Collette | |
| 2006/0198742 | A1 | 9/2006 | DiFoggio et al. | |
| 2008/0080991 | A1 | 4/2008 | Yuratich | |
| 2009/0183879 | A1 | 7/2009 | Cox | |
| 2009/0218091 | A1 | 9/2009 | Dotson | |
| 2009/0324431 | A1* | 12/2009 | van Boeyen ..... | F04B 19/24 417/379 |
| 2010/0012313 | A1 | 1/2010 | Longfield | |
| 2012/0023606 | A1 | 10/2012 | Bouldin et al. | |

FOREIGN PATENT DOCUMENTS

| | | | |
|---|---|---|---|
| GB | 2 403 752 | A | 1/2005 |
| WO | WO 01/20126 | A2 | 3/2001 |
| WO | WO 2009/077714 | | 6/2009 |
| WO | WO 2011/079218 | A2 | 6/2011 |

* cited by examiner

NESTED BELLOWS PUMP AND HYBRID DOWNHOLE PUMPING SYSTEM EMPLOYING SAME

CROSS REFERENCE TO RELATED APPLICATIONS

This application claims the benefit of U.S. Provisional Application Ser. No. 62/523,110 filed Jun. 21, 2017 titled "Nested Bellows Pump and Hybrid Downhole Pumping System Employing Same", and U.S. Provisional Application Ser. No. 62/491,563 filed Apr. 28, 2017 titled "Nested Bellows Pump and Hybrid Downhole Pumping System Employing Same", the disclosures of which are incorporated herein by reference in their entirety.

FIELD OF THE INVENTION

The present disclosure is directed generally to systems and methods for artificial lift in a wellbore and more specifically to systems and methods that utilize a downhole bellows pump to remove a wellbore liquid from the wellbore.

BACKGROUND

A hydrocarbon well may be utilized to produce gaseous hydrocarbons from a subterranean formation. Often, a wellbore liquid may build up within one or more portions of the hydrocarbon well. This wellbore liquid, which may include water, condensate, and/or liquid hydrocarbons, may impede flow of the gaseous hydrocarbons from the subterranean formation to a surface region via the hydrocarbon well, thereby reducing and/or completely blocking gaseous hydrocarbon production from the hydrocarbon well.

Traditionally, plunger lift and/or rod pump systems have been utilized to provide artificial lift and to remove this wellbore liquid from the hydrocarbon well. While these systems may be effective under certain circumstances, they may not be capable of efficiently removing the wellbore liquid from long and/or deep hydrocarbon wells, from hydrocarbon wells that include one or more deviated (or nonlinear) portions (or regions), and/or from hydrocarbon wells in which the gaseous hydrocarbons do not generate at least a threshold pressure.

As an illustrative, non-exclusive example, plunger lift systems require that the gaseous hydrocarbons develop at least the threshold pressure to provide a motive force to convey a plunger between the subterranean formation and the surface region. As another illustrative, non-exclusive example, rod pump systems utilize a mechanical linkage (i.e., a rod) that extends between the surface region and the subterranean formation; and, as the depth of the well (or length of the mechanical linkage) is increased, the mechanical linkage becomes more prone to failure and/or more prone to damage the casing. As yet another illustrative, non-exclusive example, neither plunger lift systems nor rod pump systems may be utilized effectively in wellbores that include deviated and/or nonlinear regions.

Improved hydrocarbon well drilling technologies permit an operator to drill a hydrocarbon well that extends for many thousands of meters within the subterranean formation, that has a vertical depth of hundreds, or even thousands, of meters, and/or that has a highly deviated wellbore. These improved drilling technologies are routinely utilized to drill long and/or deep hydrocarbon wells that permit production of gaseous hydrocarbons from previously inaccessible subterranean formations.

However, wellbore liquids cannot be removed efficiently from these hydrocarbon wells using traditional artificial lift systems. Thus, there exists a need for improved systems and methods for artificial lift to remove wellbore liquids from a hydrocarbon well.

SUMMARY

In one aspect, disclosed herein is a nested bellows pump for use in a system for removing wellbore liquids from a wellbore. The nested bellows pump includes a housing having a first end and a second end, the housing having a cylindrical body, the cylindrical body having an inner wall; a traveling bulkhead, the traveling bulkhead sealingly positionable along the inner wall of the cylindrical body; a first inner bellows having a first end and a second end, the first end of the first inner bellows connected to the first end of the housing, and the second end of the first inner bellows is connected to the first end of the traveling bulkhead; a second inner bellows having a first end and a second end, the first end of the second inner bellows connected to the second end of the traveling bulkhead, and the second end of the second inner bellows is connected to the second end of the housing; a first outer bellows having a first end and a second end, the first end of the first outer bellows connected to the first end of the housing, and the second end of the first outer bellows is connected to the first end of the traveling bulkhead; and a second outer bellows having a first end and a second end, the first end of the second outer bellows connected to the second end of the traveling bulkhead, and the second end of the second outer bellows is connected to the second end of the housing.

In some embodiments, the first inner bellows and the first outer bellows are coaxially aligned with the first end of the housing and form a first pair of nested bellows.

In some embodiments, the second inner bellows and the second outer bellows are coaxially aligned with the second end of the housing and form a second pair of nested bellows.

In some embodiments, each chamber is fluid tight.

In some embodiments, each chamber has an inlet port and an outlet port.

In some embodiments, wherein the inlet port and the outlet port of the first inner chamber and the inlet port and the outlet port of the first outer chamber are positioned on the first end of the housing.

In some embodiments, the inlet port and the outlet port of the second inner chamber and the inlet port and the outlet port of the second outer chamber are positioned on the second end of the housing.

In some embodiments, each inlet port and each outlet port are in fluid communication with a one-way check valve.

In some embodiments, the first inner chamber and the second inner chamber are in fluid communication with a closed loop hydraulic system.

In some embodiments, the closed loop hydraulic system includes a power end pump for pressurizing the first inner chamber or the second inner chamber.

In some embodiments, the first and second inner bellows and the first and second outer bellows are structured and arranged to compress and expand in accordance with pressurization of the first inner chamber or the second inner chamber.

In some embodiments, the traveling bulkhead reciprocates in response to the compression and expansion of the first and second inner bellows.

In some embodiments, the pump includes a traveling bulkhead position sensor for determining when the traveling bulkhead has reached a predetermined stroke length.

In some embodiments, the traveling bulkhead position sensor measure a value selected from bulkhead position, pressure, time, or a combination thereof.

In another aspect, disclosed herein is a system for removing wellbore liquids from a wellbore, the wellbore traversing a subterranean formation and having a tubular that extends within at least a portion of the wellbore, the system comprising: a nested bellows pump comprising a housing having a first end and a second end, the housing having a cylindrical body, the cylindrical body having an inner wall; a traveling bulkhead, the traveling bulkhead sealingly positionable along the inner wall of the cylindrical body; a first inner bellows having a first end and a second end, the first end of the first inner bellows connected to the first end of the housing, and the second end of the first inner bellows is connected to the first end of the traveling bulkhead; a second inner bellows having a first end and a second end, the first end of the second inner bellows connected to the second end of the traveling bulkhead, and the second end of the second inner bellows is connected to the second end of the housing; a first outer bellows having a first end and a second end, the first end of the first outer bellows connected to the first end of the housing, and the second end of the first outer bellows is connected to the first end of the traveling bulkhead; a second outer bellows having a first end and a second end, the first end of the second outer bellows connected to the second end of the traveling bulkhead, and the second end of the second outer bellows is connected to the second end of the housing; wherein a first inner chamber is defined by the first inner bellows, a second inner chamber is defined by the second inner bellows, a first outer chamber is defined by an annulus formed by the first outer bellows and the first inner bellows, and a second outer chamber is defined by the second outer bellows and the second inner bellows; a closed loop hydraulic system in fluid communication with the first inner chamber and the second inner chamber of the nested bellows pump; and a power end pump for pressurizing the first inner chamber or the second inner chamber of the nested bellows pump; wherein the power end pump and the pump form a pump assembly.

In some embodiments, the first inner bellows and the first outer bellows are coaxially aligned with the first end of the housing and form a first pair of nested bellows.

In some embodiments, the second inner bellows and the second outer bellows are coaxially aligned with the second end of the housing and form a second pair of nested bellows.

In some embodiments, each chamber has an inlet port and an outlet port.

In some embodiments, the inlet port and the outlet port of the first inner chamber and the inlet port and the outlet port of the first outer chamber are positioned on the first end of the housing, and the inlet port and the outlet port of the second inner chamber and the inlet port and the outlet port of the second outer chamber are positioned on the second end of the housing.

In some embodiments, each inlet port and each outlet port are in fluid communication with a one-way check valve.

In some embodiments, the first and second inner bellows and the first and second outer bellows are structured and arranged to compress and expand in accordance with pressurization of the first inner chamber or the second inner chamber.

In some embodiments, the traveling bulkhead reciprocates in response to the compression and expansion of the first and second inner bellows.

In some embodiments, the system includes a traveling bulkhead position sensor for determining when the traveling bulkhead has reached a predetermined stroke length.

In some embodiments, the traveling bulkhead position sensor measure a value selected from bulkhead position, pressure, time, or a combination thereof.

In some embodiments, a signal from the traveling bulkhead position sensor is relayed to the power end pump to reverse the pumping direction of the power end pump.

In some embodiments, the system includes a second power end pump, wherein a signal from the traveling bulkhead position sensor is relayed to the first power end pump or the second power end pump to change the direction of the traveling bulkhead.

In some embodiments, a profile seating nipple is positioned within the tubular for receiving the pump assembly, the profile seating nipple having a locking groove structured and arranged to matingly engage the solid state pump.

In some embodiments, the system includes a well screen or filter in fluid communication with the inlet end of the pump, the well screen or filter having an inlet end and an outlet end; and a velocity fuse positioned between the outlet end of the well screen or filter and the inlet end of the pump.

In some embodiments, the velocity fuse is structured and arranged to back-flush the well screen or filter and maintain a column of fluid within the tubular in response to an increase in pressure drop across the velocity fuse.

In some embodiments, the system includes an apparatus for reducing the force required to pull the positive-displacement solid state pump from the tubular, the apparatus comprising a tubular sealing device for mating with the positive-displacement solid state pump, the tubular sealing device having an axial length and a longitudinal bore therethrough; and an elongated rod slidably positionable within the longitudinal bore of the tubular sealing device, the elongated rod having an axial flow passage extending therethrough, a first end, a second end, and an outer surface, the outer surface structured and arranged to provide a hydraulic seal when the elongated rod is in a first position within the longitudinal bore of the tubular sealing device, and at least one external flow port for pressure equalization upstream and downstream of the tubular sealing device when the elongated rod is placed in a second position within the longitudinal bore of the tubular sealing device, wherein the tubular sealing device is structured and arranged for landing within a nipple profile or for attaching to a collar stop for landing directly within the tubular.

In some embodiments, the apparatus is structured and arranged to be installed and retrieved from the tubular by a wireline or a coiled tubing.

In yet another aspect, disclosed herein is a method of removing wellbore liquid from a wellbore, the wellbore traversing a subterranean formation and having a tubular that extends within at least a portion of the wellbore, the method comprising: powering a downhole power end pump, the downhole power end pump in fluid communication with a closed loop hydraulic system; and driving a nested bellows pump, the nested bellows pump in fluid communication with the closed loop hydraulic system and comprising a housing having a first end and a second end, the housing having a cylindrical body, the cylindrical body having an inner wall;

a traveling bulkhead, the traveling bulkhead sealingly positionable along the inner wall of the cylindrical body; a first inner bellows having a first end and a second end, the first end of the first inner bellows connected to the first end of the housing, and the second end of the first inner bellows is connected to the first end of the traveling bulkhead; a second inner bellows having a first end and a second end, the first end of the second inner bellows connected to the second end of the traveling bulkhead, and the second end of the second inner bellows is connected to the second end of the housing; a first outer bellows having a first end and a second end, the first end of the first outer bellows connected to the first end of the housing, and the second end of the first outer bellows is connected to the first end of the traveling bulkhead; a second outer bellows having a first end and a second end, the first end of the second outer bellows connected to the second end of the traveling bulkhead, and the second end of the second outer bellows is connected to the second end of the housing; wherein a first inner chamber is defined by the first inner bellows, a second inner chamber is defined by the second inner bellows, a first outer chamber is defined by an annulus formed by the first outer bellows and the first inner bellows, and a second outer chamber is defined by the second outer bellows and the second inner bellows; pumping the wellbore liquid from the wellbore with the pump, wherein the pumping step includes: (i) pressurizing the wellbore liquid with the nested bellows pump to generate a pressurized wellbore liquid at a discharge pressure; and (ii) flowing the pressurized wellbore liquid at least a threshold vertical distance to a surface region.

In some embodiments, the first inner bellows and the first outer bellows are coaxially aligned with the first end of the housing and form a first pair of nested bellows.

In some embodiments, the second inner bellows and the second outer bellows are coaxially aligned with the second end of the housing and form a second pair of nested bellows.

In some embodiments, the method further includes producing a hydrocarbon gas from the subterranean formation at least partially concurrently with the pumping.

In some embodiments, the step of powering the downhole power end pump comprises using a power cable, the power cable operable for deploying the downhole power end pump.

In some embodiments, the power cable comprises a synthetic conductor.

In some embodiments, the step of powering the downhole power end pump comprises using a rechargeable battery.

In some embodiments, the downhole power end pump is plugged into a downhole wet-mate connection and the step of powering the downhole power end pump comprises using a power cable positioned on the outside of the tubular.

In some embodiments, the method includes the step of positioning a profile seating nipple within the tubular for receiving the solid state pump, the profile seating nipple having a locking groove structured and arranged to matingly engage the solid state pump.

In some embodiments, the method includes the step of positioning a well screen or filter in fluid communication with the pump, the well screen or filter having an inlet end and an outlet end; and a velocity fuse positioned between the outlet end of the well screen or filter and the pump.

In some embodiments, the velocity fuse is structured and arranged to back-flush the well screen or filter and maintain a column of fluid within the tubular in response to an increase in pressure drop across the velocity fuse.

In some embodiments, the downhole power end pump and pump form a pump assembly, further comprising the step of reducing the force required to pull the pump assembly from the tubular by using an apparatus comprising a tubular sealing device for mating with the pump assembly, the tubular sealing device having an axial length and a longitudinal bore therethrough; and an elongated rod slidably positionable within the longitudinal bore of the tubular sealing device, the elongated rod having an axial flow passage extending therethrough, a first end, a second end, and an outer surface, the outer surface structured and arranged to provide a hydraulic seal when the elongated rod is in a first position within the longitudinal bore of the tubular sealing device, and at least one external flow port for pressure equalization upstream and downstream of the tubular sealing device when the elongated rod is placed in a second position within the longitudinal bore of the tubular sealing device, wherein the tubular sealing device is structured and arranged for landing within a nipple profile or for attaching to a collar stop for landing directly within the tubular.

In some embodiments, the apparatus is structured and arranged to be installed and retrieved from the tubular by a wireline or a coiled tubing.

In some embodiments, the method further includes detecting a downhole process parameter.

In some embodiments, the downhole process parameter includes at least one of a downhole temperature, a downhole pressure, the discharge pressure, a downhole flow rate, and the discharge flow rate.

BRIEF DESCRIPTION OF THE DRAWINGS

The present disclosure is susceptible to various modifications and alternative forms, specific exemplary implementations thereof have been shown in the drawings and are herein described in detail. It should be understood, however, that the description herein of specific exemplary implementations is not intended to limit the disclosure to the particular forms disclosed herein. This disclosure is to cover all modifications and equivalents as defined by the appended claims. It should also be understood that the drawings are not necessarily to scale, emphasis instead being placed upon clearly illustrating principles of exemplary embodiments of the present invention. Moreover, certain dimensions may be exaggerated to help visually convey such principles. Further where considered appropriate, reference numerals may be repeated among the drawings to indicate corresponding or analogous elements. Moreover, two or more blocks or elements depicted as distinct or separate in the drawings may be combined into a single functional block or element. Similarly, a single block or element illustrated in the drawings may be implemented as multiple steps or by multiple elements in cooperation. The forms disclosed herein are illustrated by way of example, and not by way of limitation, in the figures of the accompanying drawings and in which like reference numerals refer to similar elements and in which:

DETAILED DESCRIPTION

Terminology

Figure 1:
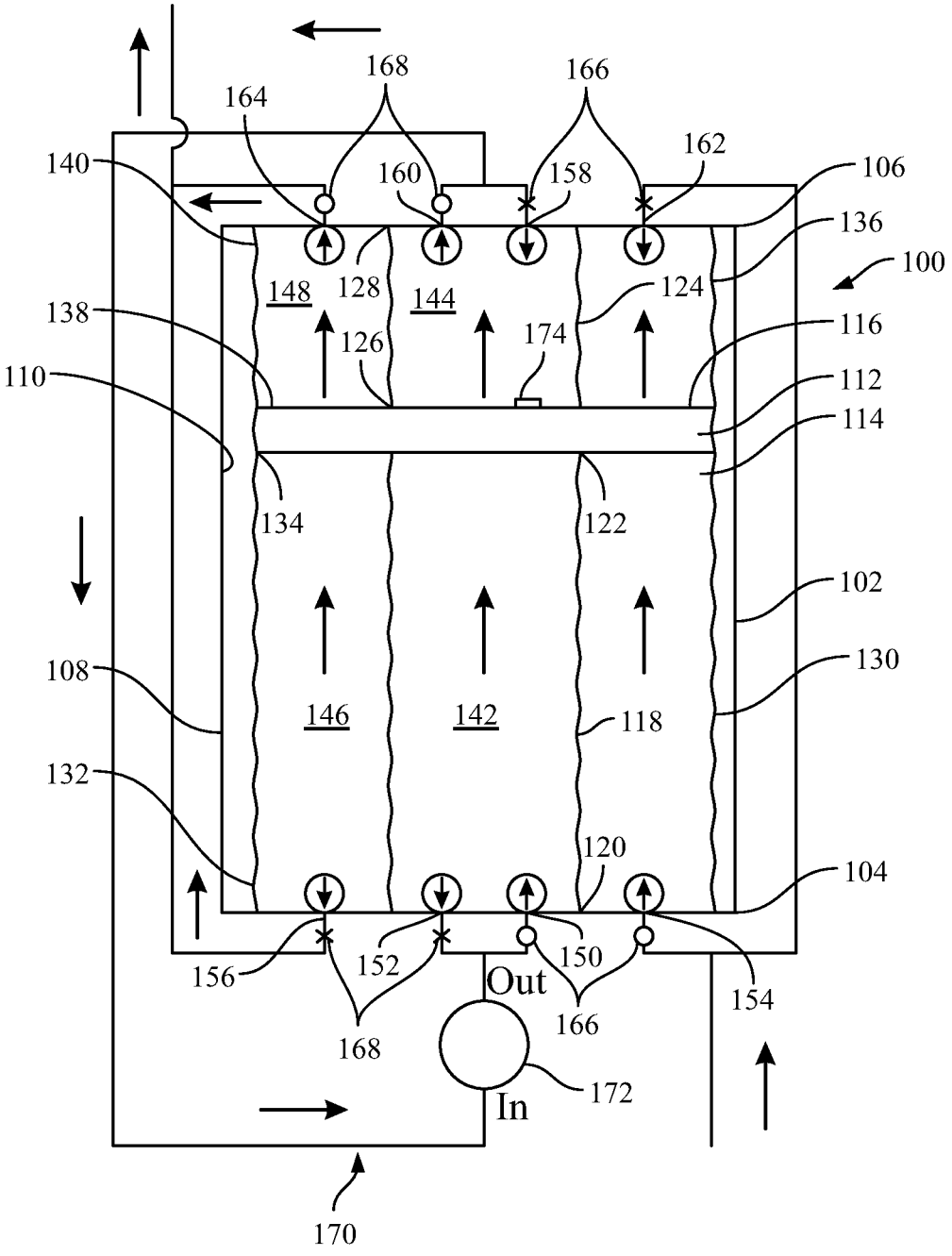
FIG. 1 is a schematic representation of illustrative, non-exclusive example of a pump that may be utilized with the systems and methods, according to the present disclosure.

The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than the broadest meaning understood by skilled artisans, such a special or clarifying definition will be expressly set forth in the specification in a definitional manner that provides the special or clarifying definition for the term or phrase.

For example, the following discussion contains a non-exhaustive list of definitions of several specific terms used in this disclosure (other terms may be defined or clarified in a definitional manner elsewhere herein). These definitions are intended to clarify the meanings of the terms used herein. It is believed that the terms are used in a manner consistent with their ordinary meaning, but the definitions are nonetheless specified here for clarity.

A/an: The articles "a" and "an" as used herein mean one or more when applied to any feature in embodiments and implementations of the present invention described in the specification and claims. The use of "a" and "an" does not limit the meaning to a single feature unless such a limit is specifically stated. The term "a" or "an" entity refers to one or more of that entity. As such, the terms "a" (or "an"), "one or more" and "at least one" can be used interchangeably herein.

About: As used herein, "about" refers to a degree of deviation based on experimental error typical for the particular property identified. The latitude provided the term "about" will depend on the specific context and particular property and can be readily discerned by those skilled in the art. The term "about" is not intended to either expand or limit the degree of equivalents which may otherwise be afforded a particular value. Further, unless otherwise stated, the term "about" shall expressly include "exactly," consistent with the discussion below regarding ranges and numerical data.

Above/below: In the following description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore. Continuing with the example of relative directions in a wellbore, "upper" and "lower" may also refer to relative positions along the longitudinal dimension of a wellbore rather than relative to the surface, such as in describing both vertical and horizontal wells.

And/or: The term "and/or" placed between a first entity and a second entity means one of (1) the first entity, (2) the second entity, and (3) the first entity and the second entity. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements). As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of".

Any: The adjective "any" means one, some, or all indiscriminately of whatever quantity.

At least: As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements). The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

Based on: "Based on" does not mean "based only on", unless expressly specified otherwise. In other words, the phrase "based on" describes both "based only on," "based at least on," and "based at least in part on."

Comprising: In the claims, as well as in the specification, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

Couple: Any use of any form of the terms "connect", "engage", "couple", "attach", or any other term describing an interaction between elements is not meant to limit the interaction to direct interaction between the elements and may also include indirect interaction between the elements described.

Determining: "Determining" encompasses a wide variety of actions and therefore "determining" can include calculating, computing, processing, deriving, investigating, looking up (e.g., looking up in a table, a database or another data structure), ascertaining and the like. Also, "determining" can include receiving (e.g., receiving information), accessing (e.g., accessing data in a memory) and the like. Also, "determining" can include resolving, selecting, choosing, establishing and the like.

Embodiments: Reference throughout the specification to "one embodiment," "an embodiment," "some embodiments," "one aspect," "an aspect," "some aspects," "some implementations," "one implementation," "an implementation," or similar construction means that a particular component, feature, structure, method, or characteristic described in connection with the embodiment, aspect, or implementation is included in at least one embodiment and/or implementation of the claimed subject matter. Thus, the appearance of the phrases "in one embodiment" or "in an embodiment" or "in some embodiments" (or "aspects" or "implementations") in various places throughout the specification are not necessarily all referring to the same embodiment and/or implementation. Furthermore, the particular features, structures, methods, or characteristics may be combined in any suitable manner in one or more embodiments or implementations.

Exemplary: "Exemplary" is used exclusively herein to mean "serving as an example, instance, or illustration." Any embodiment described herein as "exemplary" is not necessarily to be construed as preferred or advantageous over other embodiments.

Flow diagram: Exemplary methods may be better appreciated with reference to flow diagrams or flow charts. While for purposes of simplicity of explanation, the illustrated methods are shown and described as a series of blocks, it is to be appreciated that the methods are not limited by the order of the blocks, as in different embodiments some blocks may occur in different orders and/or concurrently with other blocks from that shown and described. Moreover, less than all the illustrated blocks may be required to implement an exemplary method. In some examples, blocks may be combined, may be separated into multiple components, may employ additional blocks, and so on. In some examples, blocks may be implemented in logic. In other examples, processing blocks may represent functions and/or actions performed by functionally equivalent circuits (e.g., an analog circuit, a digital signal processor circuit, an application specific integrated circuit (ASIC)), or other logic device. Blocks may represent executable instructions that cause a computer, processor, and/or logic device to respond, to perform an action(s), to change states, and/or to make decisions. While the figures illustrate various actions occurring in serial, it is to be appreciated that in some examples various actions could occur concurrently, substantially in series, and/or at substantially different points in time. In some examples, methods may be implemented as processor executable instructions. Thus, a machine-readable medium may store processor executable instructions that if executed by a machine (e.g., processor) cause the machine to perform a method.

Full-physics: As used herein, the term "full-physics," "full physics computational simulation," or "full physics simulation" refers to a mathematical algorithm based on first principles that impact the pertinent response of the simulated system.

May: Note that the word "may" is used throughout this application in a permissive sense (i.e., having the potential to, being able to), not a mandatory sense (i.e., must).

Operatively connected and/or coupled: Operatively connected and/or coupled means directly or indirectly connected for transmitting or conducting information, force, energy, or matter.

Optimizing: The terms "optimal," "optimizing," "optimize," "optimality," "optimization" (as well as derivatives and other forms of those terms and linguistically related words and phrases), as used herein, are not intended to be limiting in the sense of requiring the present invention to find the best solution or to make the best decision. Although a mathematically optimal solution may in fact arrive at the best of all mathematically available possibilities, real-world embodiments of optimization routines, methods, models, and processes may work towards such a goal without ever actually achieving perfection. Accordingly, one of ordinary skill in the art having benefit of the present disclosure will appreciate that these terms, in the context of the scope of the present invention, are more general. The terms may describe one or more of: 1) working towards a solution which may be the best available solution, a preferred solution, or a solution that offers a specific benefit within a range of constraints; 2) continually improving; 3) refining; 4) searching for a high point or a maximum for an objective; 5) processing to reduce a penalty function; 6) seeking to maximize one or more factors in light of competing and/or cooperative interests in maximizing, minimizing, or otherwise controlling one or more other factors, etc.

Order of steps: It should also be understood that, unless clearly indicated to the contrary, in any methods claimed herein that include more than one step or act, the order of the steps or acts of the method is not necessarily limited to the order in which the steps or acts of the method are recited.

Ranges: Concentrations, dimensions, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a range of about 1 to about 200 should be interpreted to include not only the explicitly recited limits of 1 and about 200, but also to include individual sizes such as 2, 3, 4, etc. and sub-ranges such as 10 to 50, 20 to 100, etc. Similarly, it should be understood that when numerical ranges are provided, such ranges are to be construed as providing literal support for claim limitations that only recite the lower value of the range as well as claims limitation that only recite the upper value of the range. For example, a disclosed numerical range of 10 to 100 provides literal support for a claim reciting "greater than 10" (with no upper bounds) and a claim reciting "less than 100" (with no lower bounds).

As used herein, the term "formation" refers to any definable subsurface region. The formation may contain one or more hydrocarbon-containing layers, one or more non-hydrocarbon containing layers, an overburden, and/or an underburden of any geologic formation.

As used herein, the term "hydrocarbon" refers to an organic compound that includes primarily, if not exclusively, the elements hydrogen and carbon. Examples of hydrocarbons include any form of natural gas, oil, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions, or at ambient conditions (20° C. and 1 atm pressure). Hydrocarbon fluids may include, for example, oil, natural gas, gas condensates, coal bed methane, shale oil, shale gas, and other hydrocarbons that are in a gaseous or liquid state.

As used herein, the term "potting" refers to the encapsulation of electrical components with epoxy, elastomeric, silicone, or asphaltic or similar compounds for the purpose of excluding moisture or vapors. Potted components may or may not be hermetically sealed.

As used herein, the term "sensor" includes any electrical sensing device or gauge. The sensor may be capable of monitoring or detecting pressure, temperature, fluid flow, vibration, resistivity, or other formation data. Alternatively, the sensor may be a position sensor.

As used herein, the term "subsurface" refers to geologic strata occurring below the earth's surface.

The terms "tubular member" or "tubular body" refer to any pipe, such as a joint of casing, a portion of a liner, a drill string, a production tubing, an injection tubing, a pup joint, a buried pipeline, underwater piping, or above-ground piping, solid lines therein, and any suitable number of such structures and/or features may be omitted from a given embodiment without departing from the scope of the present disclosure.

As used herein, the term "wellbore" refers to a hole in the subsurface made by drilling or insertion of a conduit into the subsurface. A wellbore may have a substantially circular cross section, or other cross-sectional shape. As used herein, the term "well," when referring to an opening in the formation, may be used interchangeably with the term "wellbore."

The terms "zone" or "zone of interest" refer to a portion of a subsurface formation containing hydrocarbons. The term "hydrocarbon-bearing formation" may alternatively be used.

Description

Specific forms will now be described further by way of example. While the following examples demonstrate certain forms of the subject matter disclosed herein, they are not to be interpreted as limiting the scope thereof, but rather as contributing to a complete description.

FIGS. 1-9 provide illustrative, non-exclusive examples of a pump, and a system and method for removing fluids from a subterranean well, according to the present disclosure, together with elements that may include, be associated with, be operatively attached to, and/or utilize such a method or system.

In FIGS. 1-9, like numerals denote like, or similar, structures and/or features; and each of the illustrated structures and/or features may not be discussed in detail herein with reference to the figures. Similarly, each structure and/or feature may not be explicitly labeled in the figures; and any structure and/or feature that is discussed herein with reference to the figures may be utilized with any other structure and/or feature without departing from the scope of the present disclosure.

In general, structures and/or features that are, or are likely to be, included in a given embodiment are indicated in solid lines in the figures, while optional structures and/or features are indicated in broken lines. However, a given embodiment is not required to include all structures and/or features that are illustrated in solid lines therein, and any suitable number of such structures and/or features may be omitted from a given embodiment without departing from the scope of the present disclosure.

Although the approach disclosed herein can be applied to a variety of subterranean well designs and operations, the present description will primarily be directed to a pump and systems for removing fluids from a subterranean well.

Figure 2:
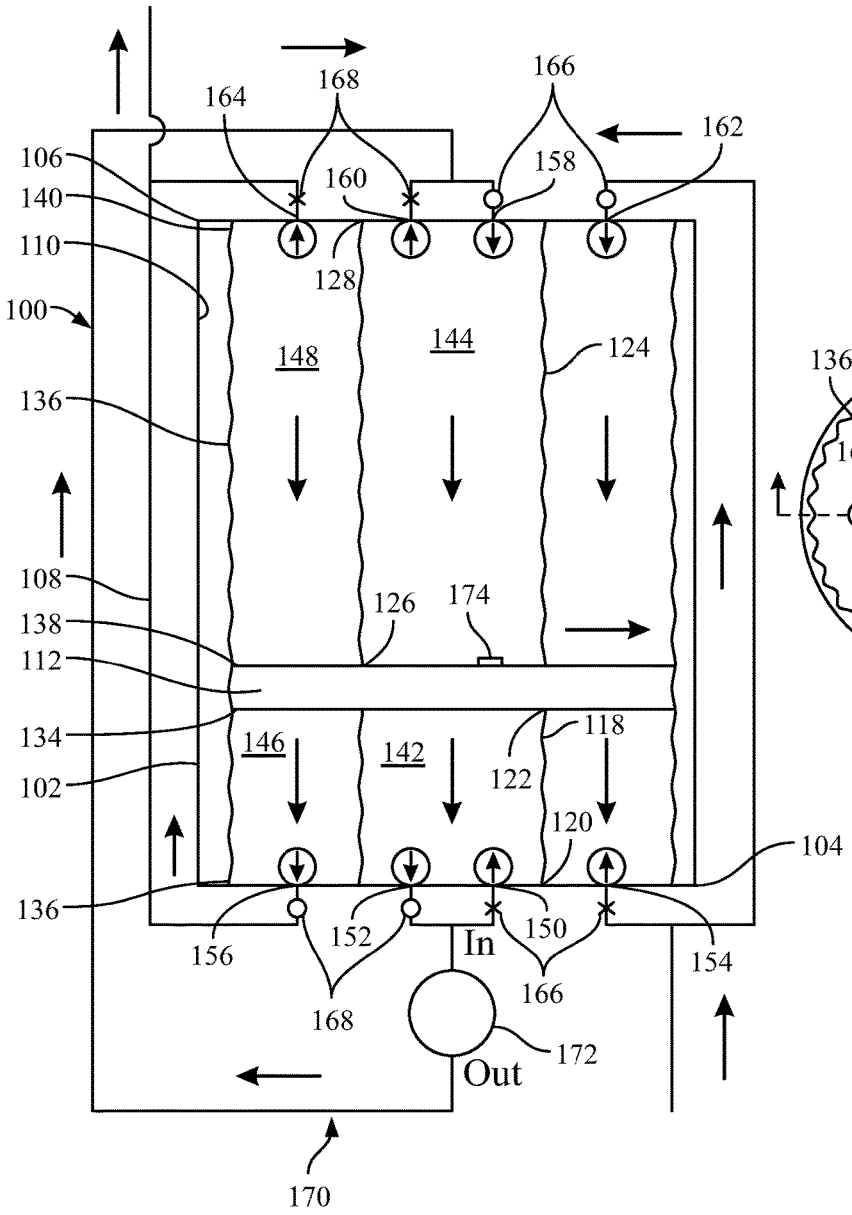
FIG. 2 is another representation of an illustrative, non-exclusive example of a pump that may be utilized with the systems and methods, according to the present disclosure.
Figure 3:
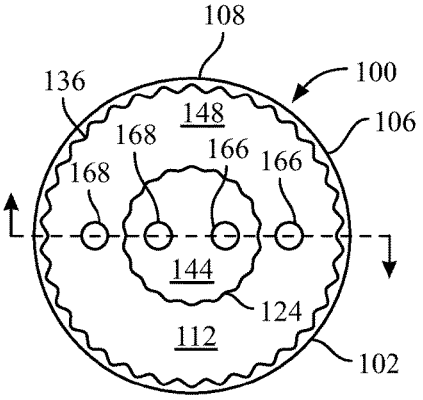
FIG. 3 is a top view of the illustrative, non-exclusive examples of the pump of FIGS. 1 and 2.

Referring now to FIGS. 1-3, schematic representations of an illustrative, non-exclusive example of a nested bellows fluid end pump 100, according to the present disclosure, are presented. In accordance herewith, the nested bellows fluid end pump 100 may be used in a system for removing wellbore liquids from a wellbore (See FIG. 3, described hereinbelow).

The nested bellows fluid end pump 100 includes a housing 102 having a first end 104 and a second end 106. The housing 102 includes a cylindrical body 108, the cylindrical body 108 having an inner wall 110.

As shown, the nested bellows fluid end pump 100 includes a traveling bulkhead 112. The traveling bulkhead 112 is sealingly positionable along the inner wall 110 of the cylindrical body 108 of housing 102. Traveling bulkhead 112 has a first end 114 and a second end 116.

The nested bellows fluid end pump 100 further includes a first inner bellows 118. First inner bellows 118 has a first end 120 and a second end 122. The first end 120 of the first inner bellows 118 is operatively connected to the first end 104 of the housing 102. The second end 122 of the first inner bellows 118 is operatively connected to the first end 114 of the traveling bulkhead 112. The nested bellows fluid end pump 100 also includes a second inner bellows 124 having a first end 126 and a second end 128. The first end 126 of the second inner bellows 124 is operatively connected to the second end 116 of the traveling bulkhead 112, and the second end 128 of the second inner bellows 124 is connected to the second end 106 of the housing 102.

The nested bellows fluid end pump 100 further includes a first outer bellows 130 having a first end 132 and a second end 134. The first end 132 of the first outer bellows 130 is operatively connected to the first end 104 of the housing 102. The second end 134 of the first outer bellows 130 is operatively connected to the first end 114 of the traveling bulkhead 112. The nested bellows fluid end pump 100 also includes a second outer bellows 136 having a first end 138 and a second end 140, the first end 138 of the second outer bellows 136 is operatively connected to the second end 116 of the traveling bulkhead 112, and the second end 140 of the second outer bellows 136 is operatively connected to the second end 106 of the housing 102.

In some embodiments, the first inner bellows 118 and the first outer bellows 130 are coaxially aligned with the first end 104 of the housing 102 and form a first pair of nested bellows. In some embodiments, the second inner bellows 124 and the second outer bellows 136 are coaxially aligned with the second end 106 of the housing 102 and form a second pair of nested bellows.

Still referring to FIGS. 1-3, as may be appreciated, a first inner chamber 142 is defined by the first inner bellows 118, and a second inner chamber 144 is defined by the second inner bellows 124. A first outer chamber 146 is defined by an annulus formed by the first outer bellows 130 and the first inner bellows 118, and a second outer chamber 148 is defined by the second outer bellows 136 and the second inner bellows 124. In some embodiments, each chamber 142, 144, 146 and 148 is fluid tight. In some embodiments, each chamber 142, 144, 146 and 148 has an inlet port and an outlet port.

In some embodiments, an inlet port 150 and an outlet port 152 of the first inner chamber 142 are positioned on the first end 104 of the housing 102. In some embodiments, an inlet port 154 and an outlet port 156 of the first outer chamber 146 are positioned on the first end 104 of the housing 102.

In some embodiments, an inlet port 158 and an outlet port 160 of the second inner chamber 144 are positioned on the second end 106 of the housing 102. In some embodiments, an inlet port 162 and an outlet port 164 of the second outer chamber 148 are positioned on the second end 106 of the housing 102.

In some embodiments, each inlet port 150, 154, 158 and 162 are in fluid communication with a one-way check valve 166. In some embodiments, each outlet port 152, 156, 160 and 164 are in fluid communication with a one-way check valve 168.

In some embodiments, the first inner chamber 142 and the second inner chamber 144 are in fluid communication with a closed loop hydraulic system 170. In some embodiments, the closed loop hydraulic system 170 includes a power end pump 172 for pressurizing the first inner chamber 142 or the second inner chamber 144.

As may be appreciated by those familiar with bellows-type pumps, the first and second inner bellows 118 and 124, and the first and second outer bellows 130 and 136, are structured and arranged to compress and expand in accordance with pressurization of the first inner chamber 142 or the second inner chamber 144. As shown by comparing FIG. 1 to FIG. 2, the traveling bulkhead 112 may reciprocate in response to the compression and expansion of the first and second inner bellows 118 and 124.

In some embodiments, the nested bellows fluid end pump 100, may include a traveling bulkhead position sensor 174 for determining when the traveling bulkhead has reached a predetermined stroke length. In some embodiments, the traveling bulkhead position sensor measures a value selected from bulkhead position, pressure, time, or a combination thereof.

Figure 4:
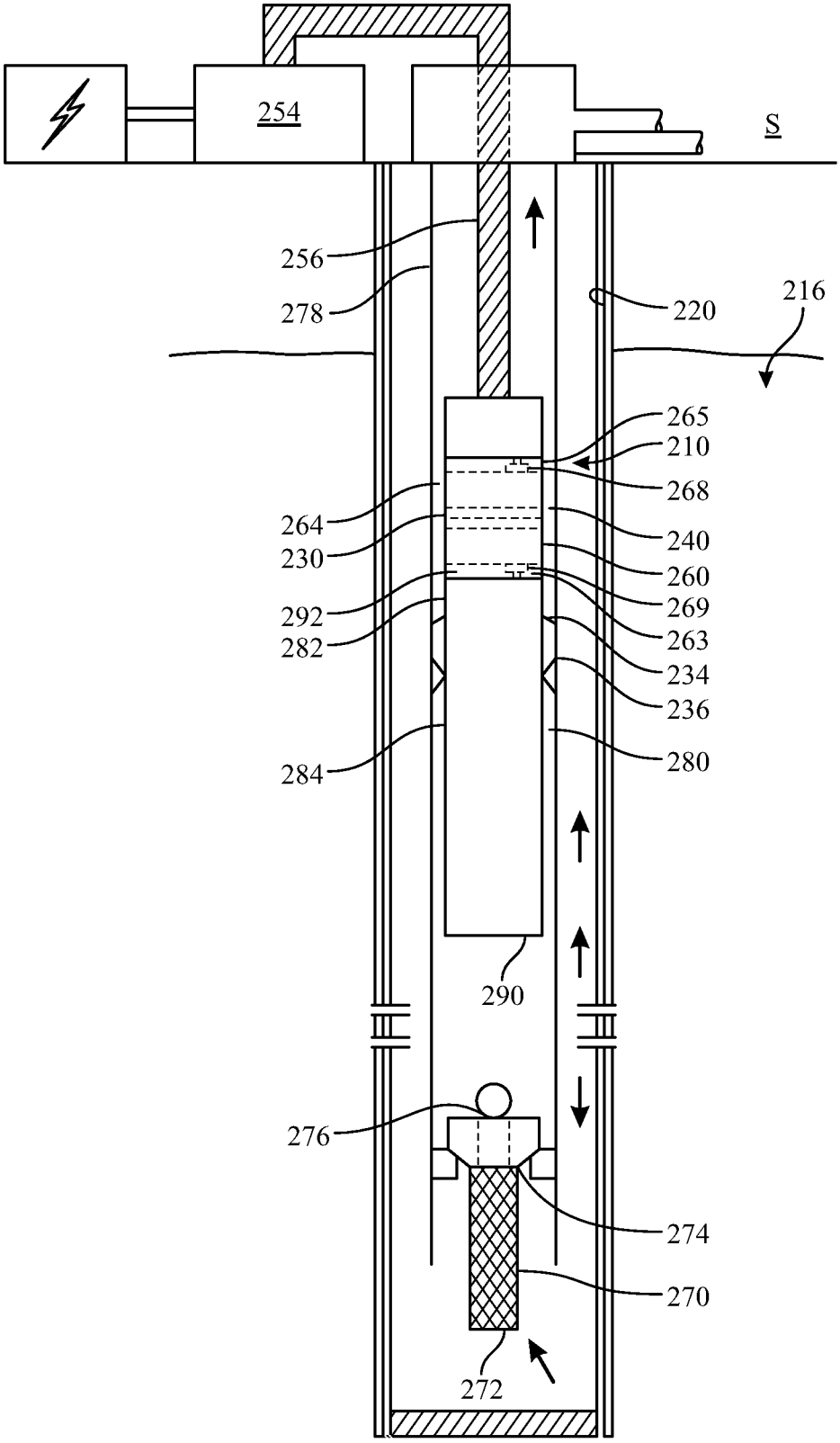
FIG. 4 is a schematic representation of illustrative, non-exclusive examples of a hydrocarbon well that may be utilized with and/or may include the systems and methods, according to the present disclosure.

Referring now to FIG. 4, a schematic representation of an illustrative, non-exclusive example of a system 210 for removing wellbore liquids from a wellbore 220, the wellbore 220 traversing a subterranean formation 216 and having a tubular 278 that extends within at least a portion of the wellbore 220, according the present disclosure is presented. The system 210 includes a power end pump 240, which, in some embodiments, may be a positive-displacement solid state pump comprising a fluid chamber 264, an inlet port 263 and an outlet port 265, each in fluid communication with the fluid chamber 264. At least one solid state element or actuator 260 may be provided, together with a first one-way check valve 269 positioned between the inlet port 263 and the fluid chamber 264, and a second one-way check valve 268 positioned between the outlet port 265 and the fluid chamber 264. In some embodiments, the at least one solid state actuator 260 may be configured to operate at or near its resonance frequency. As shown, the power end pump 240 is positioned within the wellbore 220.

Means for powering the solid state pump 254 is provided and may include any suitable structure that may be configured to provide the electric current to power end pump 240, and/or to solid state element or actuator 260 thereof, and may be present in any suitable location.

The system 210 further includes a nested bellows fluid end pump 280 for transferring the wellbore liquids from the wellbore 220. In the configuration of FIG. 4, the inlet port 263 and the outlet port 265 of the power end pump 240 are operatively connected to a hydraulic system 282 to drive the nested bellows fluid end pump 280 and form a pump assembly 284.

In some embodiments, the nested bellows fluid end pump 280 may be of the type described in detail above with respect to FIGS. 1-3. In some embodiments, nested bellows fluid end pump 280 is a metal bellows pump or an elastomer pump.

As an illustrative, non-exclusive example, means for powering the solid state pump 254 may be located in surface region S, and electrical conduit 256 may extend between the means for powering the solid state pump 254 and the positive-displacement solid state pump 240. Illustrative, non-exclusive examples of electrical conduit 256 include any suitable wire, power cable, wireline, and/or working line, and electrical conduit 256 may connect to positive-displacement solid state pump 240 via any suitable electrical connection and/or wet-mate connection.

As another illustrative, non-exclusive example, means for powering the solid state pump 254 may include and/or be a rechargeable battery pack. The battery pack may be located within surface region, may be located within wellbore 220, and/or may be operatively and/or directly attached to positive-displacement solid state pump 240.

As indicated above, means for powering the solid state pump 254 may include and/or be a generator, an AC generator, a DC generator, a turbine, a solar-powered means for powering the solid state pump, a wind-powered means for powering the solid state pump, and/or a hydrocarbon-powered means for powering the solid state pump that may be located within surface region S and/or within wellbore 220. When means for powering the solid state pump 254 is located within wellbore 220, the means for powering the solid state pump also may be referred to herein as a downhole power generation assembly. In some embodiments, the means for powering the solid state pump 254 is a power cable 256, the power cable operable for deploying the solid state pump 240. In some embodiments, the power cable 256 comprises a synthetic conductor.

In some embodiments, the power end pump 240 may be plugged into a downhole wet-mate connection (not shown) and the means for powering the solid state pump 254, is a power cable positioned on the outside of the tubular 220.

As indicated above, at least one solid state element or actuator 260 may be provided in the case where the power end pump 240 comprises a positive-displacement solid state pump. The at least one solid state actuator 260 may be selected from piezoelectric, electrostrictive and/or magnetorestrictive actuators. In some embodiments, the at least one solid state actuator 260 comprises a ceramic perovskite material. The ceramic perovskite material may comprise lead zirconate titanate and/or lead magnesium niobate. In some embodiments, the at least one solid state actuator 260 may comprise terbium dysprosium iron.

A first one-way check valve 269 may be positioned between the inlet port 263 and the fluid chamber 264. Likewise, a second one-way check valve 268 may be positioned between the outlet port 265 and the fluid chamber 264. In some embodiments, the first one-way check valve 269 and/or the second one-way check valve 268 are active/passive microvalve arrays. In some embodiments, the first one-way check valve 269 and the second one-way check valve 268 are active/passive MEMS valve arrays. In some embodiments, the first one-way check valve 269 and/or the second one-way check valve 268 are either active/passive microvalve arrays, or active/passive MEMS valve arrays, or a combination thereof.

In some embodiments, the power end pump 240 includes a diaphragm 230 that is operatively associated with the at least one solid state actuator 260 and the first and second the one-way check valves, 269 and 268, respectively, so as to form a diaphragm pump.

In some embodiments, the power end pump 240 may include a piston and a cylinder for housing the at least one solid state actuator and the first and second one-way check valves, so as to form a piston pump.

In some embodiments, the system 210 may include a profile seating nipple 234 positioned within the tubular 220 for receiving the power end pump 240. In some embodiments, the profile seating nipple 234 comprises a locking groove 236 structured and arranged to matingly engage the pump assembly 280.

The system 210 may include a well screen or filter 270 in fluid communication with the inlet end 290 of the pump assembly 280, the well screen or filter 270 having an inlet end 272 and an outlet end 274. As shown, a velocity fuse or standing valve 276 may be positioned after the outlet end 274 of the well screen or filter 270. In some embodiments, the velocity fuse 276 may be structured and arranged to back-flush the well screen or filter 270 and maintain a column of fluid within the tubular 278 in response to an increase in pressure drop across the velocity fuse 276.

Suitable velocity fuses are commercially available from a variety of sources, including the Hydraulic Valve Division of Parker Hannifin Corporation, Elyria, Ohio, USA, and Vonberg Valve, Inc., Rolling Meadows, Ill., USA. In particular, two sizes of commercially available velocity fuses are expected to have utility in the practice of the present disclosure. These are: a velocity fuse having a 1" OD, with a flow range of 11 liters/minute (3 GPM) to 102 liters/minute (27 GPM), and a velocity of having a 1.5" OD, with a flow range of: 23 liters/minute (6 GPM) to 227 liters/minute (60 GPM). Each of these commercially available velocity sleeves have a maximum working pressure of 5,000 psi and a temperature ratings of −20 F to +350 F (−27 C to +177 C). The body and sleeve are made of brass, and the poppet, roll pin, and spring are made of stainless steel. O-rings are both nitrile and PTFE. Custom-built velocity fuses are envisioned and may provide a higher pressure rated device, if needed, which may be incorporated into a housing for seating in the no-go profile nipple.

As indicated above, the nested bellows fluid end nested bellows pump disclosed herein may be used in combination with a power end pump to create a hybrid pumping assembly. The pumping assembly may be sized and configured to meet volumetric and pressure requirements, while not requiring a mechanical connection to the surface.

The disclosed pumping assembly pumps a closed volume of fluid using a power end pump, using that high-pressure fluid to actuate the nested bellows fluid end nested bellows pump described herein. The nested bellows fluid end pump may interact directly with the wellbore fluids, driving them to the surface. The power end pump may be optimized for the expected pumping conditions. Suitable options for the power end pump include but are not limited to piezoelectric, solid state, rotary positive displacement, bladder (bellows, elastomer, etc.), centrifugal, rotary screw, rotary lobe, gerotor, piston, and/or progressive cavity pumps. In some embodiments, the hybrid pumping assembly can protect the power end pump and its associated check valves, discussed above, by isolating them from wellbore fluids. The hybrid pumping assembly allows for additional design flexibility on the nested bellows fluid end while enhancing the reliability of the power end.

The designs disclosed herein may advantageously keep the pump hydraulic system completely separate from the exposure to wellbore fluids. Since corrosive wellbore fluids are no longer required to be exposed to the prime fluid mover, as they would be in positive displacement pump, centrifugal pump or rod type pump systems, with stationary and traveling valves, the life cycle of the pump and system may be significantly extended.

Likewise, solids laden wellbore fluids, which are known to be very erosive in nature, are no longer exposed to the prime fluid mover as they are in positive displacement pump, centrifugal pump and rod type pump devices, with stationary and traveling valves. Sand fines from proppant used during fracture treatment of the formation, and/or formation fines themselves, tend to cut out and erode pump components and valves. With the use of the traveling bulk head disclosed herein, no moving parts are exposed to the wellbore fluids except the check valves used for controlling fluid entry and exit. As may be appreciated, this can significantly reduce the number of potential failure points overall.

The nested bellows fluid end pumps disclosed herein permit the use of alloys that can be specifically designed for the well fluid application desired. For example, key components may be designed to be $H_2S$ resistant, or survive low pH and or high $CO_2$ environments. As compared with other pump types, the amount and machining of stainless steel is much smaller. It amounts to the pounds of stainless steel required to form the bellows, as compared to a pump barrel, or the centrifugal stages in a pump. The alloys employed to form the bellows may be used to fit specific needs or requirements of the application. This may result in a change in the actual working length of the pump. As may be appreciated, there may be significant room for expansion in vertical applications.

As disclosed hereinabove, the nested bellows pump includes four main components: a two-part inner bellows, a two-part outer bellows, a traveling bulkhead that separates the inner/outer bellows sections, and inlet/outlet check valves for each bellows section. The nested bellows pump operates as follows: The power end pump provides a high pressure closed-volume pumped fluid, to the side below the traveling bulkhead, of the inner bellows. The high pressure pump fluid causes the lower inner bellows to expand, drawing low pressure well fluid into the adjacent lower outer bellows.

As shown in FIG. 1, as the lower inner bellows expands, the traveling bulkhead is pushed toward the upper side. This compresses the wellbore fluid already in the upper outer bellows, pumping it toward the surface. Low pressure pump fluid is exhausted from the upper inner bellows so that it can be returned to the power end pump intake.

As shown in FIGS. 1 and 2, one or more sensors, which could be a one or more position sensors, pressure sensors, timers, or the like, may be employed to indicate when the traveling bulkhead has reached its intended stroke length. The signal is relayed to the power end pump, causing it to reverse its pumping direction. In another embodiment, two power end pumps could be used. The pumps would have the ability to move the traveling bulkhead in opposite directions, alternating operation based on receiving the appropriate signals.

As shown in FIG. 2, when the direction is reversed, the power end pump provides high pressure pump fluid to the upper inner bellows. The upper inner bellows expands, drawing low pressure well fluid into the adjacent upper outer bellows. The traveling bulkhead is pushed toward the lower side as the upper inner bellows expands. This compresses the wellbore fluid already in the lower outer bellows, pumping it toward the surface. Low pressure pump fluid is exhausted from the lower inner bellows such that it can be returned to the power end pump intake. As may be appreciated, the process may be repeated to continuously remove fluids from the well.

As may be appreciated by those skilled in the art, the nested bellows fluid end pump designs disclosed provide the ability to tailor the size of the surface area of the traveling bulkhead and inner and outer bellows to meet the specific requirements of an individual well, since the exposed surface area of the inner or outer bellows relates to 1) pump volume; and 2) pressure the pump can develop to lift fluid from extreme depths.

In some embodiments, the bellows and the traveling bulkhead may be formed from a wide variety of materials, such metal alloys, elastomers, fibers, plastics, or the like, depending upon the conditions to be encountered and relevant life-cycle requirements.

As previously described, the nested bellows fluid end pump provides additional design flexibility. As an example, the internal volume of the nested bellows could be increased to reduce operational cycles required to produce a given volume of fluid. The cross-sectional area of the bellows could be adjusted to optimize the discharge pumping pressure/rate for a desired configuration. The bellows materials could be specified to meet individual wellbore needs (e.g., for resistance against corrosive fluids, chemical inhibitors, stimulation treatments, expected temperatures/pressures). In other embodiments, the traveling bulkhead could be driven mechanically with a rod (as in a sucker rod pumping system), linear electric motor, rotary motor with actuator conversion, or other suitable reciprocating device.

As multiple nested bellows fluid end pumping stages are not required, the pumping system may be short enough to be lubricated into a well, eliminating the need for possibly damaging heavy kill fluids or an expensive downhole fluid isolation valve. A short system length would allow the pump to traverse highly deviated and tortuous sections of a well, unlike an ESP. A standard wireline (or coiled tubing) truck may deploy the pump into the well, greatly reducing the costs for installation/deployment when compared to a workover rig. It should also be possible to "pump the pump" into a horizontal section of a wellbore, and pull it back with the wireline "tether" that was used to deploy it. The pumping system may also be deployed via an integral propulsion apparatus. The pump could be installed with an integral retrievable isolation packer or it could be landed in a seating nipple.

The fluid end nested bellows pump, disclosed herein, may utilize edge welded metal bellows technology to provide an all-metal pressure barrier and seal that flexes in one or more directions. Edge welded metal bellows provide the most flex in the smallest amount of space of any bellows technology, up to a 90% stroke length. The process for manufacturing edge welded metal bellows begins with hydraulically stamping strips of metal sheets into diaphragms. Next, the diaphragms are positioned back-to-back (male to female) to pair the inside diameter holes. They are then welded together through plasma, laser, arc, or electron beam welding equipment depending on the manufacturer and material. Vision systems can aid the accuracy and consistency of welds. The entire process is continued in order to make the proper number of convolutions. Once the inside diameter welds are completed, the convolutions are prepared for outside diameter welding. Depending on the welding equipment, chill rings are inserted between the convolutions in order to ensure that the heat from the welds does not distort or change material properties in the adjacent material.

Suitable edge welded metal bellows may be obtained from BellowsTech, LLC of Ormond Beach, Fla., Senior Aerospace Metal Bellows, Senior Operations LLC of Sharon, Mass., and others.

Figure 5:
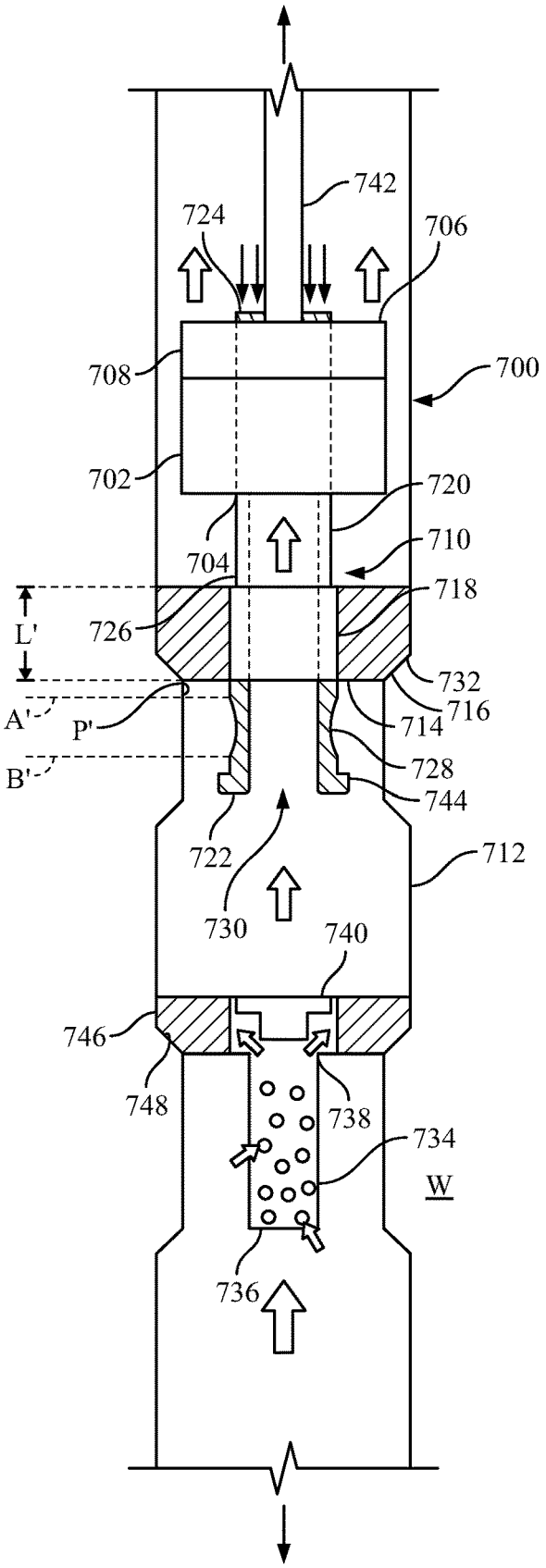
FIG. 5 presents a cross-sectional view of an illustrative, nonexclusive example of a velocity fuse having utility in the flushable well screen or filter assemblies of the present disclosure.

Referring now to FIG. 5, a schematic view of an illustrative, nonexclusive example of a system for 700 removing fluids from a well, according to the present disclosure is presented. As shown, the system 700 may include an apparatus 710 for reducing the force required to pull a pump assembly 702 from a tubular 712. The system 700 includes the pump assembly 702, which may be the type described for FIG. 4, above, pump assembly 702 having an inlet end 704 and a discharge end 706. A telemetry section 708 is operatively connected to the pump assembly 702.

As shown, the apparatus 710 may be positioned upstream of the pump assembly 702. Apparatus 710 includes a tubular sealing device 714 for mating with a downhole tubular component 716, the tubular sealing device 714 having an axial length L' and a longitudinal bore 718 therethrough.

Apparatus 710 also includes an elongated rod 720, slidably positionable within the longitudinal bore 718 of the tubular sealing device 714. The elongated rod 720 includes a first end 722, a second end 724, and an outer surface 726. As shown in FIG. 5, the outer surface 726 is structured and arranged to provide a hydraulic seal when the elongated rod is in a first position (when position A' is aligned with point P') within the longitudinal bore 718 of the tubular sealing device 714. Also, as shown in FIG. 5, the outer surface 726 of elongated rod 720 is structured and arranged to provide at least one external flow port 728 for pressure equalization upstream and downstream of the tubular sealing device 714 when the elongated rod 720 is placed in a second position (when position B' is aligned with point P') within the longitudinal bore 718 of the tubular sealing device 714.

In some embodiments, the elongated rod 720 includes an axial flow passage 730 extending therethrough, the axial flow passage in fluid communication with the pump assembly 702.

In some embodiments, the tubular sealing device 714 is structured and arranged for landing within a nipple profile (not shown) or for attaching to a collar stop 732 for landing directly within the tubular 712.

In some embodiments, a well screen or filter 734 is provided, the well screen or filter 734 in fluid communication with the inlet end 704 of the pump assembly 702, the well screen or filter 734 having an inlet end 736 and an outlet end 738.

In some embodiments, a velocity fuse or standing valve 740 is positioned between the outlet end 738 of the well screen or filter 134 and the first end 122 of the elongated rod 720. As shown, the velocity fuse 740 is in fluid communication with the well screen or filter 734.

In some embodiments, the velocity fuse 740 is structured and arranged to back-flush the well screen or filter 734 and maintain a column of fluid within the tubular 712 in response to an increase in pressure drop across the velocity fuse 740. In some embodiments, the velocity fuse 740 is normally open and comprises a spring-loaded piston responsive to changes in pressure drop across the velocity fuse 740.

In some embodiments, the apparatus 710 is structured and arranged to be installed and retrieved from the tubular 712 by a wireline or a coiled tubing 742. In some embodiments, the apparatus 710 is integral to the tubing string.

In some embodiments, the first end 722 of the elongated rod 720 includes an extension 744 for applying a jarring force to the tubular sealing device 714 to assist in the removal thereof.

In some embodiments, the velocity fuse 740 may be installed within a housing 746. In some embodiments, the housing 746 is structured and arranged for sealingly engaging the tubular 712. In some embodiments, the housing 746 comprises at least one seal 748. In some embodiments, the housing 746 may be configured to seat within a tubular 712, as shown.

Figure 6:
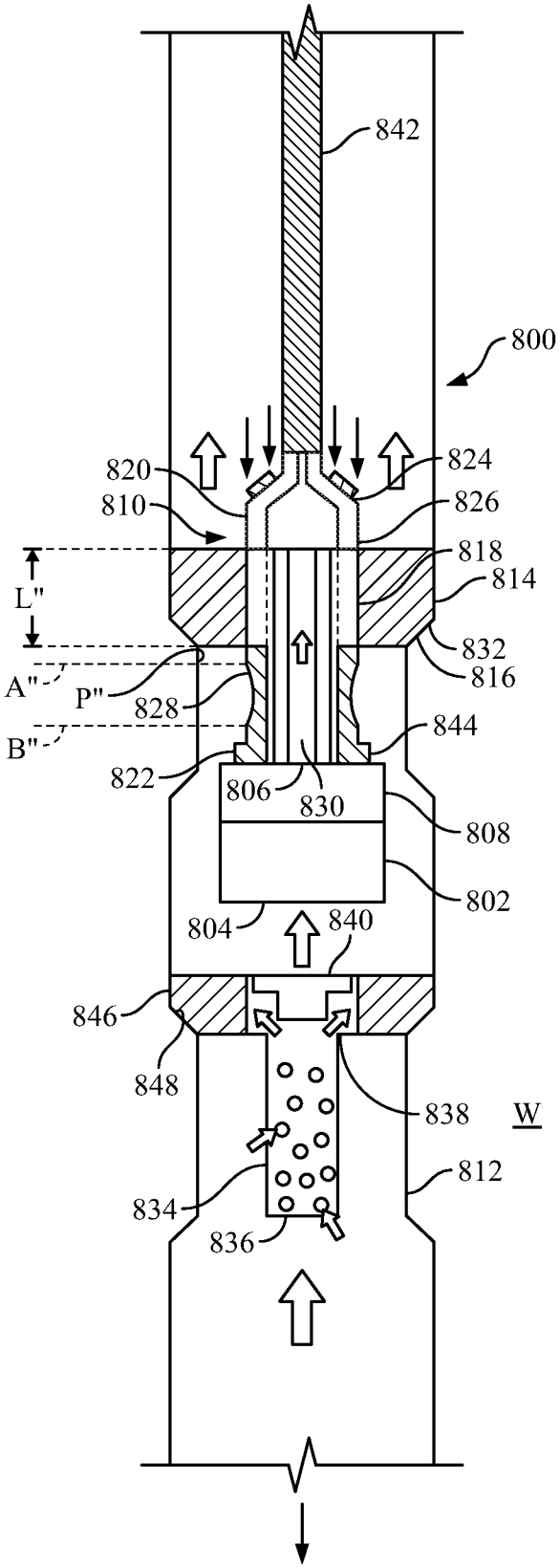
FIG. 6 presents a schematic view of an illustrative, nonexclusive example of a system for removing fluids from a well, according to the present disclosure.

Referring now to FIG. 6, a schematic view of an illustrative, nonexclusive example of a system for 800 removing fluids from a well, according to the present disclosure is presented. The system 800 includes a pump assembly 802 having an inlet end 804 and a discharge end 806. A telemetry section 808 is operatively connected to the positive-displacement solid state pump 802.

The system 800 also includes an apparatus 810 for reducing the force required to pull the pump assembly 802 from a tubular 812. As shown, the apparatus 810 may be positioned downstream of the pump assembly 802. Apparatus 810 includes a tubular sealing device 814 for mating with a downhole tubular component 816, the tubular sealing device 814 having an axial length L" and a longitudinal bore 818 therethrough.

Apparatus 810 also includes an elongated rod 820, slidably positionable within the longitudinal bore 818 of the tubular sealing device 814. The elongated rod 820 includes a first end 822, a second end 824, and an outer surface 826. As shown in FIG. 6, the outer surface 826 is structured and arranged to provide a hydraulic seal when the elongated rod is in a first position (when position A" is aligned with point P") within the longitudinal bore 818 of the tubular sealing device 814. Also, as shown in FIG. 6, the outer surface 826 of elongated rod 820 is structured and arranged to provide at least one external flow port 828 for pressure equalization upstream and downstream of the tubular sealing device 814 when the elongated rod 820 is placed in a second position (when position B" is aligned with point P") within the longitudinal bore 818 of the tubular sealing device 814.

In some embodiments, the elongated rod 820 includes an axial flow passage 830 extending therethrough, the axial flow passage in fluid communication with the pump assembly 802.

In some embodiments, the tubular sealing device 814 is structured and arranged for landing within a nipple profile (not shown) or for attaching to a collar stop 832 for landing directly within the tubular 812.

In some embodiments, a well screen or filter 834 is provided, the well screen or filter 834 in fluid communication with the inlet end 804 of the pump assembly 802, the well screen or filter 834 having an inlet end 836 and an outlet end 838.

In some embodiments, a velocity fuse or standing valve 840 is positioned between the outlet end 838 of the well screen or filter 834 and the first end 822 of the elongated rod 820. As shown, the velocity fuse or standing valve 840 is in fluid communication with the well screen or filter 834.

In some embodiments, the velocity fuse 840 is structured and arranged to back-flush the well screen or filter 834 and maintain a column of fluid within the tubular 812 in response to an increase in pressure drop across the velocity fuse 840. In some embodiments, the velocity fuse 840 is normally open and comprises a spring-loaded piston responsive to changes in pressure drop across the velocity fuse 840.

In some embodiments, the apparatus 810 is structured and arranged to be installed and retrieved from the tubular 812 by a wireline or a coiled tubing 842. In some embodiments, the apparatus 810 is integral to the tubing string.

In some embodiments, the first end 822 of the elongated rod 820 includes an extension 844 for applying a jarring force to the tubular sealing device 814 to assist in the removal thereof.

In some embodiments, the velocity fuse 840 may be installed within a housing 846. In some embodiments, the housing 846 is structured and arranged for sealingly engaging the tubular 812. In some embodiments, the housing 846 comprises at least one seal 848. In some embodiments, the housing 846 may be configured to seat within a tubular 812, as shown.

Figure 7:
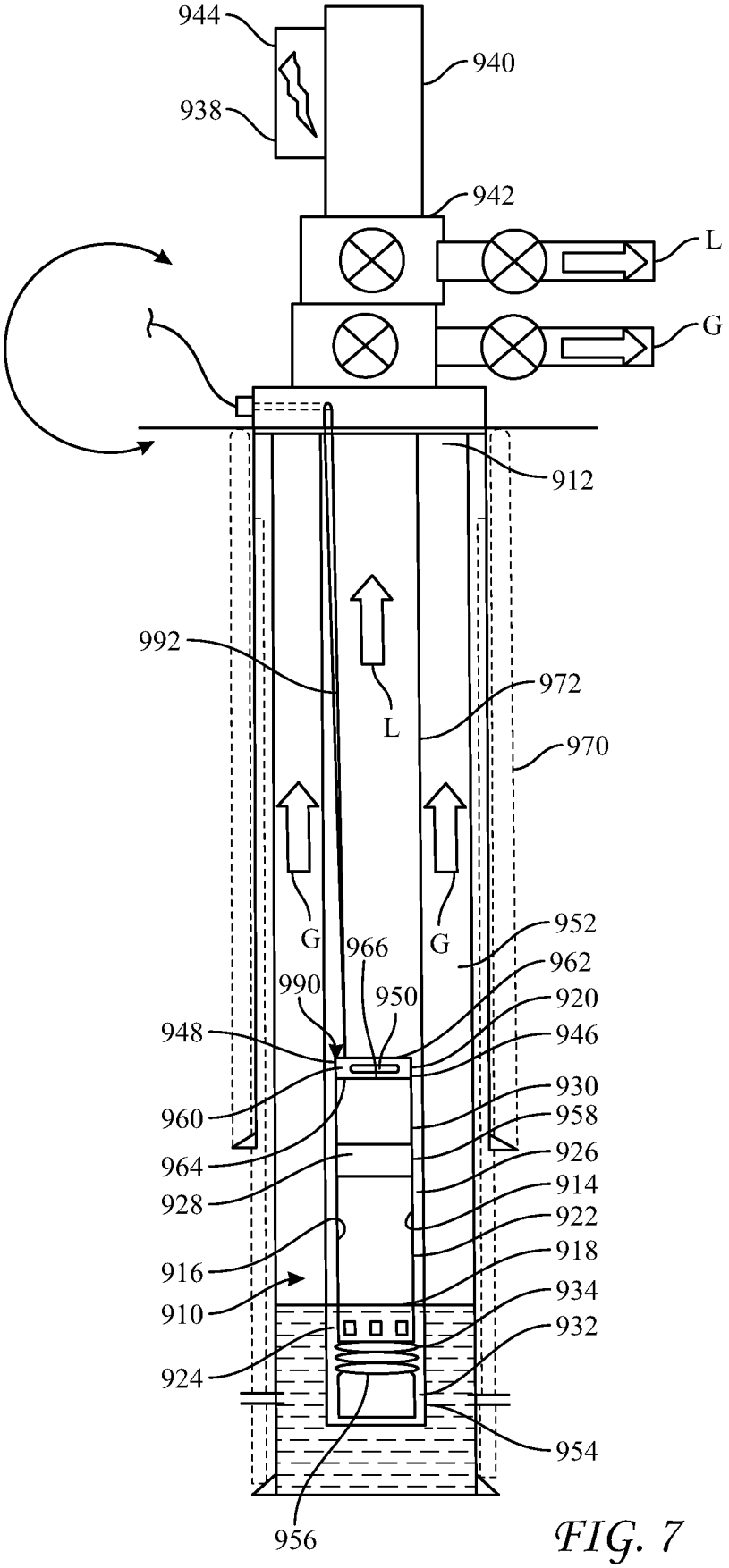
FIG. 7 presents a schematic view of an illustrative, nonexclusive example of a system for removing fluids from a subterranean well, depicted in a pumping mode, according to the present disclosure.
Figure 8:
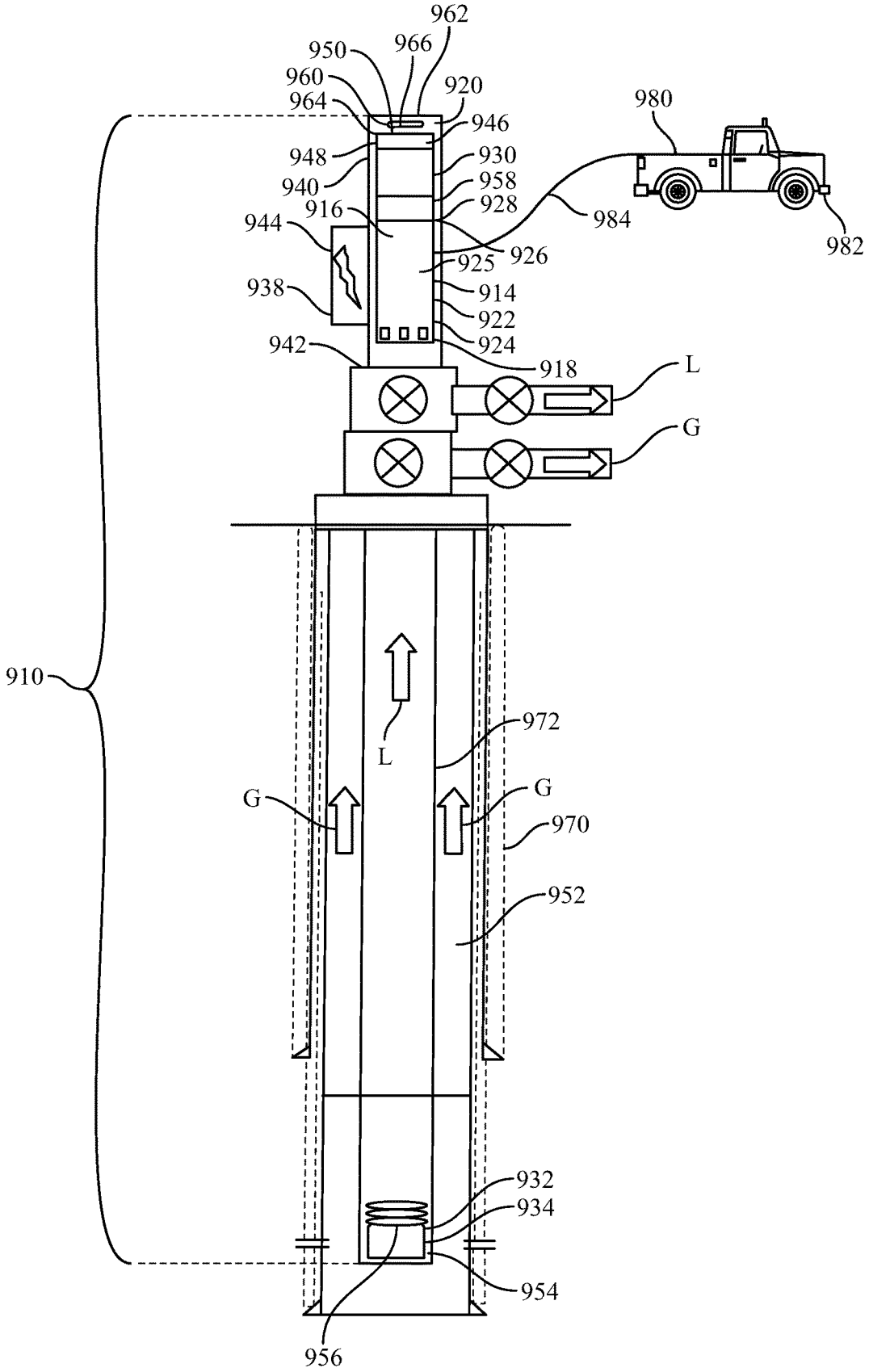
FIG. 8 presents a schematic view of an illustrative, nonexclusive example of the system for removing fluids from a subterranean well of FIG. 4, wherein the system is placed in the charging mode, according to the present disclosure.

Referring now to FIGS. 7-8, illustrated is another embodiment of a system 910 for removing fluids L from a subterranean well 912. The system 910 includes a housing 914, the housing 914 including a hollow cylindrical body 916, the hollow cylindrical body 916 having a first end 918 and a second end 920. The system 910 includes a pump assembly 922 for removing fluids from the subterranean well 912, the pump assembly 922 positioned within the hollow cylindrical body 916. Pump assembly 922 includes an inlet end 924 and a discharge end 926.

System 910 also includes a telemetry section 928. As shown in FIGS. 21-22, the telemetry section 928 is positioned within the hollow cylindrical body 916. To power pump assembly 922, a rechargeable battery 930 may be provided. In some embodiments, the rechargeable battery 930 may be positioned within the hollow cylindrical body 916. Rechargeable batteries having utility will be discussed in more detail below.

System 910 also includes an apparatus for releasably securing and sealing the housing 932. As shown, in some embodiments, the apparatus 932 may be positioned within a tubular 972 of the subterranean well 912. In some embodiments, the apparatus 932 may be a docking station 934, as shown, which forms a mechanical connection with the first end 918 of the hollow cylindrical body 916. In some embodiments, apparatus 932 may be in the form of a packer (not shown). In some embodiments, apparatus 932 may be a portion of the housing 914, itself. Other forms of apparatus 932 may have utility herein, providing they meet the requirements of securing the housing 914 and sealing the first end 918 of the hollow cylindrical body 916. In some embodiments, the apparatus 932 may include a latching bumper spring 956.

In some embodiments, the system 910 may include a battery recharging station 938 In some embodiments, the battery recharging station 938 may be positioned aboveground G, as shown in FIGS. 7-8. In some embodiments, battery recharging station 938 includes a receiver 940, which is structured and arranged to receive the housing 914 when the housing 914 is disengaged from the apparatus 932. In some embodiments, receiver 940 of battery recharging station 938 has an opening 942 at one end thereof, the opening 942 in communication with the tubular 972. As shown in FIG. 8, in some embodiments, the housing 914 is disengaged from the apparatus 932, transferred through the tubular 972 to the receiver 940 of battery recharging station 938 for charging. When positioned within the receiver 940, an electrical connection may be made with charger 944 and the rechargeable battery 930 is then charged.

In some embodiments, the system 910 may include a mobile charging unit 980 for charging the rechargeable battery 930 via cabling 984. In some embodiments, the mobile charging unit 980 may be installed in a vehicle 982, for convenience.

In some embodiments, the system 910 may include at least one sensor 946 for monitoring system conditions including the level of charge of the rechargeable battery 930. In some embodiments, the system 910 may include a communications system 948 for transmitting data obtained from the at least one sensor 946. In some embodiments, the communications system 948 transmits performance information to a supervisory control and data acquisition (SCADA) system (not shown).

In some embodiments, the rechargeable battery 930 can be recharged via a downhole wet-mate connection 990 attached to wireline having multiple electrical conductors, or a slickline 992, with a larger power-source battery (not shown), attached to the wet-mate.

As may be appreciated by those skilled in the art, a slickline is a single-strand wire used to run tools into a wellbore. Slicklines can come in varying lengths, according to the depth of the wells in the area. It may be connected to a wireline sheave, which is a round wheel grooved and sized to accept a specified line and positioned to redirect the line to another sheave that will allow it to enter the wellbore while keeping the pressure contained.

The slickline power-source battery may be transported to the subterranean well 912 on a temporary basis, or remain on or near location, and be passively charged via renewable sources such as solar or wind, or fuel cells, hydrocarbon-fueled generators, etc.

In some embodiments, the wireline or slickline 992, or the power required for recharging, can be supplied by a mobile cable spooling and charging unit (not shown). This mobile spooling and charging unit can eliminate the requirement for permanent onsite power generation, as the unit could recharge rechargeable battery 930 of pump assembly 922 while the pump assembly 922 was in-place at its pumping position in the subterranean well 912, eliminating the need to wait for the pump assembly 922 to return. The charging unit could use many different methods to produce electricity including, but not limited to, natural gas diesel generators, renewable sources, or fuel cells.

In some embodiments, the system 910 may include a surfacing system 950 for raising the housing 914 to a position within the battery recharging station 938 when the housing 914 is disengaged from the apparatus 932.

In some embodiments, the housing 914 may be disengaged from the apparatus 932 in response to a signal received from the at least one sensor 946 that the rechargeable battery 930 has reached a predetermined level of discharge.

In some embodiments, the at least one sensor 946 for monitoring system conditions includes a sensor for monitoring downhole pressure 960, and a sensor for monitoring downhole temperature 962. In some embodiments, the downhole pressure sensor 960 provides a signal to a pump-off controller 964. In some embodiments, the at least one sensor 946 provides a signal to the pump assembly 922 to change its operating speed to maintain an optimal fluid level above the pump.

In some embodiments, the surfacing system 950 is structured and arranged to raise and lower the density of the housing 914. In some embodiments, the surfacing system 950 comprises a buoyancy system. In some embodiments, the surfacing system 950 comprises a propeller system 966 or a jetting device (not shown).

In some embodiments, the subterranean well 912 further includes a casing 970, the tubular 972 positioned within the casing 970 to form an annulus 952 for producing gas G therethrough, with liquids L removed by the pump assembly 922 through the tubular 972. In some embodiments, a standing valve 954 may be provided, the standing valve 954 positioned within the tubular 972 to retain liquids within the tubular 972.

In some embodiments, the battery for powering the driver 928 may be a rechargeable battery 930.

As is known by those skilled in the art, lithium-ion batteries belong to the family of rechargeable batteries in which lithium ions move from the negative electrode to the positive electrode during discharge and back when charging. Li-ion batteries use an intercalated lithium compound as one electrode material, compared to the metallic lithium used in a non-rechargeable lithium battery. The electrolyte, which allows for ionic movement, and the two electrodes are the consistent components of a lithium-ion cell.

In some embodiments, the rechargeable battery 930 may be located on the bottom as part of the pump and motor system. In this embodiment, the rechargeable battery 930 may be charged by a wireline or power cable from the surface. This in turn may be charged by a solar, wind, or the like, system, for application in remote areas. Logic onboard the system may run the pump when the rechargeable battery 930 is sufficiently charged and shuts off when the rechargeable battery 930 is discharged or fluid is removed from the well sufficiently to achieve a low fluid level.

Lithium-ion batteries are one of the most popular types of rechargeable batteries for portable electronics, having a high energy density, no memory effect, and only a slow loss of charge when not in use. Besides consumer electronics, lithium-ion batteries are used by the military, electric vehicle and aerospace industries. Chemistry, performance, cost and safety characteristics vary across lithium-ion battery types. Consumer electronics typically employ lithium cobalt oxide ($LiCoO_2$), which offers high energy density. Lithium iron phosphate (LFP), lithium manganese oxide (LMO) and lithium nickel manganese cobalt oxide (NMC) offer lower energy density, but longer lives and inherent safety. Such batteries are widely used for electric tools, medical equipment and other roles. NMC in particular is a leading contender for automotive applications. Lithium nickel cobalt aluminum oxide (NCA) and lithium titanate (LTO) are additional specialty designs.

Lithium-ion batteries typically have a specific energy density range of: 100 to 250 Wh/kg (360 to 900 kJ/kg); a volumetric energy density range of: 250 to 620 Wh/L (900 to 1900 J/cm$^3$); and a specific power density range of: 300 to 1500 W/kg at 20 seconds and 285 Wh/I).

With regard to lithium/air batteries, those skilled in the art recognize that the lithium/air couple has a theoretical energy density that is close to the limit of what is possible for a battery (~10,000 Wh/kg). Recent advances directed to a protected lithium electrode (PLE) has moved the lithium/air battery closer to commercial reality. Primary Li/Air technology has achieved specific energies in excess of 700 Wh/kg. Rechargeable Li/Air technology is expected to achieve much higher energy densities than commercial Li-ion chemistry, since in a lithium/air battery, oxygen is utilized from the ambient atmosphere, as needed for the cell reaction, resulting in a safe, high specific energy means for powering the solid state pump.

The natural abundance, large gravimetric capacity (~1600 mAh/g) and low cost of sulfur makes it an attractive positive electrode for advanced lithium batteries. With an average voltage of about 2 V, the theoretical energy density of the Li—S couple is about 2600 Wh/I and 2500 Wh/kg. The electrochemistry of the Li—S battery is distinguished by the presence of soluble polysulfides species, allowing for high power density and a natural overcharge protection mechanism. The high specific energy of the Li—S battery is particularly attractive for applications where battery weight is a critical factor in system performance.

Lithium/seawater batteries have recently gained attention. While lithium metal is not directly compatible with water, the high gravimetric capacity of lithium metal, 3800 mA/g, and its highly negative standard electrode potential, Eo=−3.045 V, make it extremely attractive when combined as an electrochemical couple with oxygen or water. At a nominal potential of about 3 volts, the theoretical specific energy for a lithium/air battery is over 5000 Wh/kg for the reaction forming LiOH ($Li+\frac{1}{4}O_2+\frac{1}{2}H_2O=LiOH$) and 11,000 Wh/kg for the reaction forming $Li_2O_2$ ($Li+O_2=Li_2O_2$) or for the reaction of lithium with seawater, rivaling the energy density for hydrocarbon fuel cells and far exceeding Li-ion battery chemistry that has a theoretical specific energy of about 400 Wh/kg. The use of a protected lithium electrode (PLE) makes lithium metal electrodes compatible with aqueous and aggressive non-aqueous electrolytes. Aqueous lithium batteries may have cell voltages similar to those of conventional Li-ion or lithium primary batteries, but with much higher energy density (for $H_2O$ or $O_2$cathodes).

The University of Tokyo experimental battery uses the oxidation-reduction reaction between oxide ions and peroxide ions at the positive electrode. Peroxides are generated and dispersed due to charge and discharge reactions by using a material made by adding cobalt (Co) to the crystal structure of lithium oxide ($Li_2O$) for the positive electrode. The University of Tokyo experimental battery can realize an energy density seven times higher than that of existing lithium-ion rechargeable batteries.

The oxidation-reduction reaction between $Li_2O$ and $Li_2O_2$ (lithium peroxide) and oxidation-reduction reaction of metal Li are used at the positive and negative electrodes, respectively. The battery has a theoretical capacity of 897 mAh per 1 g of the positive/negative electrode active material, a voltage of 2.87 V and a theoretical energy density of 2,570 Wh/kg.

The energy density is 370 Wh per 1 kg of the positive/negative electrode active material, which is about seven times higher than that of existing Li-ion rechargeable batteries using $LiCoO_2$ positive electrodes and graphite negative electrodes. The theoretical energy density of the University of Tokyo battery is lower than that of lithium-air batteries (3,460 Wh/kg).

In some embodiments, the rechargeable battery 930 is selected from lithium-ion, lithium-air, lithium-seawater, or an engineered combination of battery chemistries. In some embodiments, the rechargeable battery 930 comprises a plurality of individual batteries.

Figure 9:
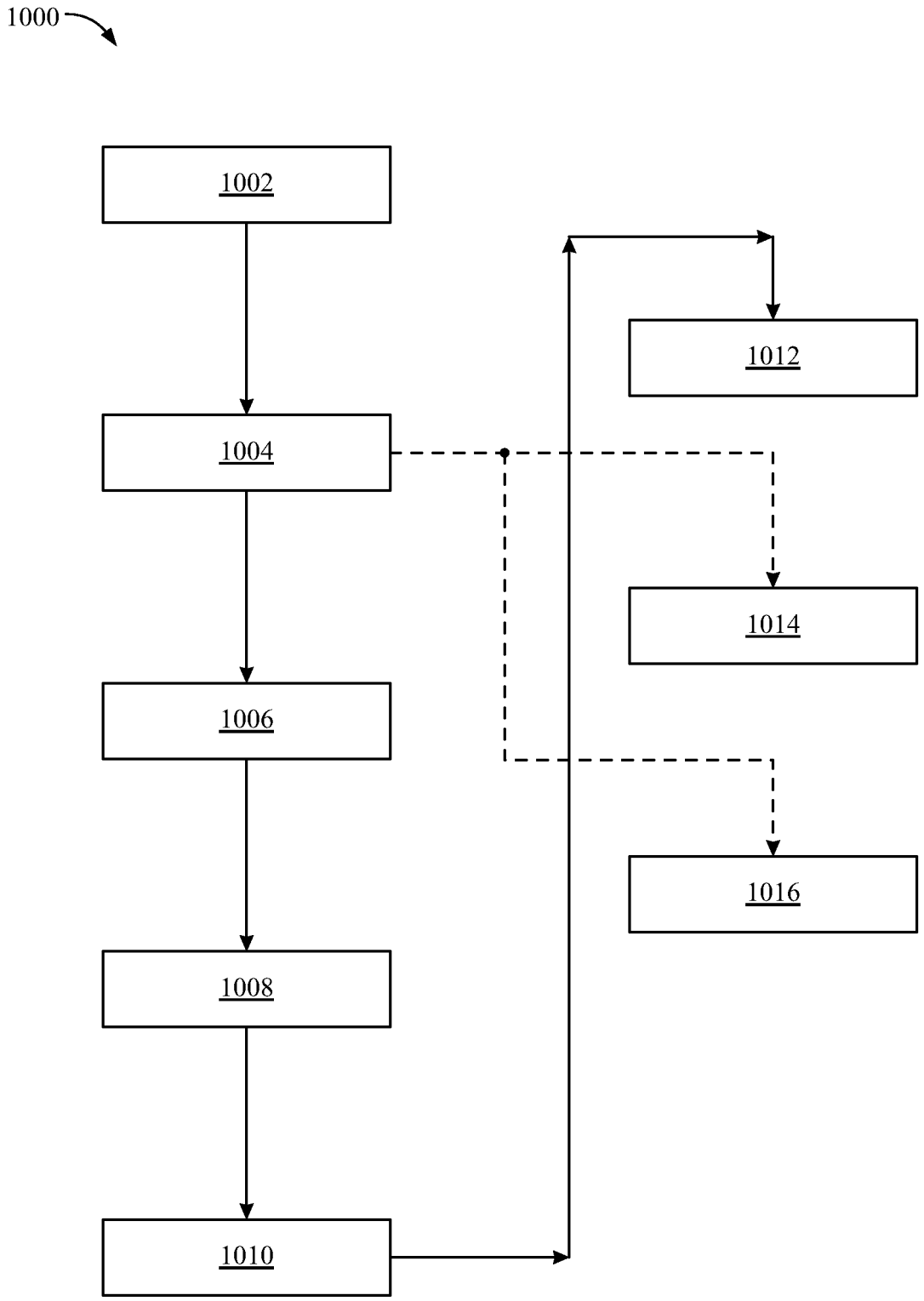
FIG. 9 is a flowchart depicting methods according to the present disclosure of removing a wellbore liquid from a wellbore.

Referring now to FIG. 9, a method of removing wellbore liquid from a wellbore 1000, the wellbore traversing a subterranean formation and having a tubular that extends within at least a portion of the wellbore is presented. The method includes: 1002, powering a downhole power end pump, the downhole power end pump in fluid communication with a closed loop hydraulic system; 1004, driving a nested bellows fluid end pump, the nested bellows fluid end pump in fluid communication with the closed loop hydraulic system and comprising a housing having a first end and a second end, the housing having a cylindrical body, the cylindrical body having an inner wall; a traveling bulkhead, the traveling bulkhead sealingly positionable along the inner wall of the cylindrical body; a first inner bellows having a first end and a second end, the first end of the first inner bellows connected to the first end of the housing, and the second end of the first inner bellows is connected to the first end of the traveling bulkhead; a second inner bellows having a first end and a second end, the first end of the second inner bellows connected to the second end of the traveling bulkhead, and the second end of the second inner bellows is connected to the second end of the housing; a first outer bellows having a first end and a second end, the first end of the first outer bellows connected to the first end of the housing, and the second end of the first outer bellows is connected to the first end of the traveling bulkhead; a second outer bellows having a first end and a second end, the first end of the second outer bellows connected to the second end of the traveling bulkhead, and the second end of the second outer bellows is connected to the second end of the housing; wherein a first inner chamber is defined by the first inner bellows, a second inner chamber is defined by the second inner bellows, a first outer chamber is defined by an annulus formed by the first outer bellows and the first inner bellows, and a second outer chamber is defined by the second outer bellows and the second inner bellows; and 1006, pumping the wellbore liquid from the wellbore with the nested bellows fluid end pump, the pumping step 1006 further includes: 1008, pressurizing the wellbore liquid with the nested bellows fluid end pump to generate a pressurized wellbore liquid at a discharge pressure; and 1010 flowing the pressurized wellbore liquid at least a threshold vertical distance to a surface region.

In some embodiments, the method further includes 1012, producing a hydrocarbon gas from the subterranean formation at least partially concurrently with the pumping.

In some embodiments, the step of powering the downhole power end pump 1004 includes 1014, using a power cable, the power cable operable for deploying the downhole power end pump. In some embodiments, the power cable comprises a synthetic conductor.

In some embodiments, the step of powering the downhole power end pump 1004 includes 1016, using a rechargeable battery.

In some embodiments, the downhole power end pump is plugged into a downhole wet-mate connection and the step of powering the downhole power end pump comprises using a power cable positioned on the outside of the tubular.

In some embodiments, the method further includes the step of positioning a profile seating nipple within the tubular for receiving the solid state pump, the profile seating nipple having a locking groove structured and arranged to matingly engage the solid state pump.

In some embodiments, the method further includes the step of positioning a well screen or filter in fluid communication with the nested bellows fluid end pump, the well screen or filter having an inlet end and an outlet end; and a velocity fuse or standing valve positioned between the outlet end of the well screen or filter and the nested bellows fluid end pump. In some embodiments, the velocity fuse is structured and arranged to back-flush the well screen or filter and maintain a column of fluid within the tubular in response to an increase in pressure drop across the velocity fuse.

In some embodiments, the downhole power end pump and the nested bellows fluid end pump form a pump assembly. In some embodiments, the method further includes the step of reducing the force required to pull the pump assembly from the tubular by using an apparatus comprising a tubular sealing device for mating with the pump assembly, the tubular sealing device having an axial length and a longitudinal bore therethrough; and an elongated rod slidably positionable within the longitudinal bore of the tubular sealing device, the elongated rod having an axial flow passage extending therethrough, a first end, a second end, and an outer surface, the outer surface structured and arranged to provide a hydraulic seal when the elongated rod is in a first position within the longitudinal bore of the tubular sealing device, and at least one external flow port for pressure equalization upstream and downstream of the tubular sealing device when the elongated rod is placed in a second position within the longitudinal bore of the tubular sealing device, wherein the tubular sealing device is structured and arranged for landing within a nipple profile or for attaching to a collar stop for landing directly within the tubular.

In some embodiments, the apparatus is structured and arranged to be installed and retrieved from the tubular by a wireline or a coiled tubing.

In some embodiments, the method further includes the step of detecting a downhole process parameter.

In some embodiments, the downhole process parameter includes at least one of a downhole temperature, a downhole pressure, the discharge pressure, a downhole flow rate, and the discharge flow rate.

In some embodiments, the first inner bellows and the first outer bellows are coaxially aligned with the first end of the housing and form a first pair of nested bellows. In some embodiments, the second inner bellows and the second outer bellows are coaxially aligned with the second end of the housing and form a second pair of nested bellows.

Illustrative, non-exclusive examples of assemblies, systems and methods according to the present disclosure have been presented. It is within the scope of the present disclosure that an individual step of a method recited herein, including in the following enumerated paragraphs, may additionally or alternatively be referred to as a "step for" performing the recited action.

INDUSTRIAL APPLICABILITY

The apparatus and methods disclosed herein are applicable to the oil and gas industry.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

While the present invention has been described and illustrated by reference to particular embodiments, those of ordinary skill in the art will appreciate that the invention lends itself to variations not necessarily illustrated herein. For this reason, then, reference should be made solely to the appended claims for purposes of determining the true scope of the present invention.

The invention claimed is:

1. A nested bellows fluid end pump for use in a system for removing wellbore liquids from a wellbore, the nested bellows fluid end pump comprising:

a housing having a first end and a second end, the housing having a cylindrical body, the cylindrical body having an inner wall;

a traveling bulkhead, the traveling bulkhead sealingly positionable along the inner wall of the cylindrical body;

a first inner bellows having a first end and a second end, the first end of the first inner bellows connected to the first end of the housing, and the second end of the first inner bellows is connected to the first end of the traveling bulkhead;

a second inner bellows having a first end and a second end, the first end of the second inner bellows connected to the second end of the traveling bulkhead, and the second end of the second inner bellows is connected to the second end of the housing;

a first outer bellows having a first end and a second end, the first end of the first outer bellows connected to the first end of the housing, and the second end of the first outer bellows is connected to the first end of the traveling bulkhead; and a second outer bellows having a first end and a second end, the first end of the second outer bellows connected to the second end of the traveling bulkhead, and the second end of the second outer bellows is connected to the second end of the housing;

wherein a first inner chamber is defined by the first inner bellows, a second inner chamber is defined by the second inner bellows, a first outer chamber is defined by an annulus formed by the first outer bellows and the first inner bellows, and a second outer chamber is defined by the second outer bellows and the second inner bellows.

2. The nested bellows fluid end pump of claim 1, wherein each chamber is fluid tight.

3. The nested bellows fluid end pump of claim 1, wherein each chamber has an inlet port and an outlet port.

4. The nested bellows fluid end pump of claim 3, wherein the inlet port and the outlet port of the first inner chamber and the inlet port and the outlet port of the first outer chamber are positioned on the first end of the housing.

5. The nested bellows fluid end pump of claim 4, wherein the inlet port and the outlet port of the second inner chamber and the inlet port and the outlet port of the second outer chamber are positioned on the second end of the housing.

6. The nested bellows fluid end pump of claim 4, wherein each inlet port and each outlet port are in fluid communication with a one-way check valve.

7. The nested bellows fluid end pump of claim 6, wherein the first inner chamber and the second inner chamber are in fluid communication with a closed loop hydraulic system.

8. The nested bellows fluid end pump of claim 7, wherein the closed loop hydraulic system includes a power end pump for pressurizing the first inner chamber or the second inner chamber.

9. The nested bellows fluid end pump of claim 8, wherein the first and second inner bellows and the first and second outer bellows are structured and arranged to compress and expand in accordance with pressurization of the first inner chamber or the second inner chamber.

10. The nested bellows fluid end pump of claim 9, wherein the traveling bulkhead reciprocates in response to the compression and expansion of the first and second inner bellows.

11. The nested bellows fluid end pump of claim 10, further comprising a traveling bulkhead position sensor for determining when the traveling bulkhead has reached a predetermined stroke length.

12. The nested bellows fluid end pump of claim 11, wherein the traveling bulkhead position sensor measure a value selected from bulkhead position, pressure, time, or a combination thereof.

13. The nested bellows fluid end pump of claim 1, wherein the first inner bellows and the first outer bellows are coaxially aligned with the first end of the housing and form a first pair of nested bellows.

14. The nested bellows fluid end pump of claim 13, wherein the second inner bellows and the second outer bellows are coaxially aligned with the second end of the housing and form a second pair of nested bellows.

15. A system for removing wellbore liquids from a wellbore, the wellbore traversing a subterranean formation and having a tubular that extends within at least a portion of the wellbore, the system comprising:

a nested bellows fluid end pump comprising a housing having a first end and a second end, the housing having a cylindrical body, the cylindrical body having an inner wall;

a traveling bulkhead, the traveling bulkhead sealingly positionable along the inner wall of the cylindrical body;

a first inner bellows having a first end and a second end, the first end of the first inner bellows connected to the first end of the housing, and the second end of the first inner bellows is connected to the first end of the traveling bulkhead;

a second inner bellows having a first end and a second end, the first end of the second inner bellows connected to the second end of the traveling bulkhead, and the second end of the second inner bellows is connected to the second end of the housing;

a first outer bellows having a first end and a second end, the first end of the first outer bellows connected to the first end of the housing, and the second end of the first outer bellows is connected to the first end of the traveling bulkhead;

a second outer bellows having a first end and a second end, the first end of the second outer bellows connected to the second end of the traveling bulkhead, and the second end of the second outer bellows is connected to the second end of the housing;

wherein a first inner chamber is defined by the first inner bellows, a second inner chamber is defined by the second inner bellows, a first outer chamber is defined by an annulus formed by the first outer bellows and the first inner bellows, and a second outer chamber is defined by the second outer bellows and the second inner bellows;

a closed loop hydraulic system in fluid communication with the first inner chamber and the second inner chamber of the nested bellows fluid end pump; and a power end pump for pressurizing the first inner chamber or the second inner chamber of the nested bellows fluid end pump;

wherein the power end pump and the nested bellows fluid end pump form a pump assembly.

16. The system of claim 15, wherein each chamber has an inlet port and an outlet port.

17. The system of claim 16, wherein the inlet port and the outlet port of the first inner chamber and the inlet port and the outlet port of the first outer chamber are positioned on the first end of the housing, and the inlet port and the outlet port of the second inner chamber and the inlet port and the outlet port of the second outer chamber are positioned on the second end of the housing.

18. The system of claim 17, wherein each inlet port and each outlet port are in fluid communication with a one-way check valve.

19. The system of claim 18, wherein the first and second inner bellows and the first and second outer bellows are structured and arranged to compress and expand in accordance with pressurization of the first inner chamber or the second inner chamber.

20. The system of claim 15, wherein the traveling bulkhead reciprocates in response to the compression and expansion of the first and second inner bellows.

21. The system of claim 20, further comprising a traveling bulkhead position sensor for determining when the traveling bulkhead has reached a predetermined stroke length.

22. The system of claim 21, wherein the traveling bulkhead position sensor measure a value selected from bulkhead position, pressure, time, or a combination thereof.

23. The system of claim 22, wherein a signal from the traveling bulkhead position sensor is relayed to the power end pump to reverse the pumping direction of the power end pump.

24. The system of claim 22, further comprising a second power end pump, wherein a signal from the traveling bulkhead position sensor is relayed to the first power end pump or the second power end pump to change the direction of the traveling bulkhead.

25. The system of claim 15, a profile seating nipple positioned within the tubular for receiving the pump assembly, the profile seating nipple having a locking groove structured and arranged to matingly engage the solid state pump.

26. The system of claim 15, further comprising a well screen or filter in fluid communication with the inlet end of the pump, the well screen or filter having an inlet end and an outlet end; and a velocity fuse or standing valve positioned between the outlet end of the well screen or filter and the inlet end of the pump.

27. The system of claim 26, wherein the velocity fuse is structured and arranged to back-flush the well screen or filter and maintain a column of fluid within the tubular in response to an increase in pressure drop across the velocity fuse.

28. The system of claim 15, further comprising an apparatus for reducing the force required to pull the positive-displacement solid state pump from the tubular, the apparatus comprising a tubular sealing device for mating with the positive-displacement solid state pump, the tubular sealing device having an axial length and a longitudinal bore therethrough; and an elongated rod slidably positionable within the longitudinal bore of the tubular sealing device, the elongated rod having an axial flow passage extending therethrough, a first end, a second end, and an outer surface, the outer surface structured and arranged to provide a hydraulic seal when the elongated rod is in a first position within the longitudinal bore of the tubular sealing device, and at least one external flow port for pressure equalization upstream and downstream of the tubular sealing device when the elongated rod is placed in a second position within the longitudinal bore of the tubular sealing device, wherein the tubular sealing device is structured and arranged for landing within a nipple profile or for attaching to a collar stop for landing directly within the tubular.

29. The system of claim 15, wherein the first inner bellows and the first outer bellows are coaxially aligned with the first end of the housing and form a first pair of nested bellows.

30. The system of claim 29, wherein the second inner bellows and the second outer bellows are coaxially aligned with the second end of the housing and form a second pair of nested bellows.

31. A method of removing wellbore liquid from a wellbore, the wellbore traversing a subterranean formation and having a tubular that extends within at least a portion of the wellbore, the method comprising:

powering a downhole power end pump, the downhole power end pump in fluid communication with a closed loop hydraulic system; and driving a nested bellows fluid end pump, the nested bellows fluid end pump in fluid communication with the closed loop hydraulic system and comprising a housing having a first end and a second end, the housing having a cylindrical body, the cylindrical body having an inner wall;

a traveling bulkhead, the traveling bulkhead sealingly positionable along the inner wall of the cylindrical body;

a first inner bellows having a first end and a second end, the first end of the first inner bellows connected to the first end of the housing, and the second end of the first inner bellows is connected to the first end of the traveling bulkhead;

a second inner bellows having a first end and a second end, the first end of the second inner bellows connected to the second end of the traveling bulkhead, and the second end of the second inner bellows is connected to the second end of the housing;

a first outer bellows having a first end and a second end, the first end of the first outer bellows connected to the first end of the housing, and the second end of the first outer bellows is connected to the first end of the traveling bulkhead;

a second outer bellows having a first end and a second end, the first end of the second outer bellows connected to the second end of the traveling bulkhead, and the second end of the second outer bellows is connected to the second end of the housing; wherein a first inner chamber is defined by the first inner bellows, a second inner chamber is defined by the second inner bellows, a first outer chamber is defined by an annulus formed by the first outer bellows and the first inner bellows, and a second outer chamber is defined by the second outer bellows and the second inner bellows;

pumping the wellbore liquid from the wellbore with the nested bellows fluid end pump, wherein the pumping step includes:

(i) pressurizing the wellbore liquid with the nested bellows fluid end pump to generate a pressurized wellbore liquid at a discharge pressure; and (ii) flowing the pressurized wellbore liquid at least a threshold vertical distance to a surface region.

32. The method of claim 31, wherein the step of powering the downhole power end pump comprises using a power cable, the power cable operable for deploying the downhole power end pump.

33. The method of claim 31, wherein the step of powering the downhole power end pump comprises using a rechargeable battery.

34. The method of claim 31, further comprising the step of positioning a profile seating nipple within the tubular for receiving the solid state pump, the profile seating nipple having a locking groove structured and arranged to matingly engage the solid state pump.

35. The method of claim 31, further comprising the step of positioning a well screen or filter in fluid communication with the nested bellows fluid end pump, the well screen or filter having an inlet end and an outlet end; and a velocity fuse or standing valve positioned between the outlet end of the well screen or filter and the nested bellows fluid end pump.

36. The method of claim 31, wherein the velocity fuse is structured and arranged to back-flush the well screen or filter and maintain a column of fluid within the tubular in response to an increase in pressure drop across the velocity fuse.

37. The method of claim 31, wherein the downhole power end pump and nested bellows fluid end pump form a pump assembly, further comprising the step of reducing the force required to pull the pump assembly from the tubular by using an apparatus comprising a tubular sealing device for mating with the pump assembly, the tubular sealing device having an axial length and a longitudinal bore therethrough; and an elongated rod slidably positionable within the longitudinal bore of the tubular sealing device, the elongated rod having an axial flow passage extending therethrough, a first end, a second end, and an outer surface, the outer surface structured and arranged to provide a hydraulic seal when the elongated rod is in a first position within the longitudinal bore of the tubular sealing device, and at least one external flow port for pressure equalization upstream and downstream of the tubular sealing device when the elongated rod is placed in a second position within the longitudinal bore of the tubular sealing device, wherein the tubular sealing device is structured and arranged for landing within a nipple profile or for attaching to a collar stop for landing directly within the tubular.

38. The method of claim 31, wherein the method further includes detecting a downhole process parameter.

* * * * *